US011647881B2

(12) United States Patent
Thorne et al.

(10) Patent No.: US 11,647,881 B2
(45) **Date of Patent: *May 16, 2023**

(54) CLEANING APPARATUS WITH COMBING UNIT FOR REMOVING DEBRIS FROM CLEANING ROLLER

(71) Applicant: SHARKNINJA OPERATING LLC, Newton, MA (US)

(72) Inventors: Jason B. Thorne, Wellesley Hills, MA (US); Yao Ming, Newton, MA (US); Daniel R. Der Marderosian, Westwood, MA (US); Daniel Meyer, Boston, MA (US); Patrick Cleary, Allston, MA (US); Gordon Howes, Suzhou (CN); David Wu, Newton, MA (US); Nancy Gao Wenxiu, Suzhou (CN)

(73) Assignee: SharkNinja Operating LLC, Needham, MA (US)

( * ) Notice: Subject to any disclaimer, the term of this patent is extended or adjusted under 35 U.S.C. 154(b) by 42 days.

This patent is subject to a terminal disclaimer.

(21) Appl. No.: 15/492,320

(22) Filed: Apr. 20, 2017

(65) Prior Publication Data

US 2017/0215667 A1 Aug. 3, 2017

Related U.S. Application Data

(63) Continuation-in-part of application No. 15/331,045, filed on Oct. 21, 2016, now Pat. No. 11,278,171, and (Continued)

(51) Int. Cl.
*A47L 9/04* (2006.01)
*A47L 9/06* (2006.01)
(Continued)

(52) U.S. Cl.
CPC ..... *A47L 9/0477* (2013.01); *A47L 5/26* (2013.01); *A47L 5/30* (2013.01); *A47L 9/0488* (2013.01); *A47L 9/0613* (2013.01); *A47L 9/30* (2013.01)

(58) Field of Classification Search
CPC ..... A47L 9/0477; A47L 11/4041; A47L 5/30; A47L 9/0488
See application file for complete search history.

(56) References Cited

U.S. PATENT DOCUMENTS 2,032,345 A * 3/1936 Cranon ..... A47L 11/33 15/48
2,411,488 A 11/1946 White
(Continued)

FOREIGN PATENT DOCUMENTS

CN 201861563 U 6/2011
CN 203662686 6/2014
(Continued)

OTHER PUBLICATIONS

International Search Report and Written Opinion dated Mar. 17, 2017 in corresponding PCT Patent Application No. PCT/US 16/58155, 12 pgs.
(Continued)

*Primary Examiner* — Bryan R Muller
(74) *Attorney, Agent, or Firm* — Grossman Tucker Perreault & Pfleger, PLLC

(57) ABSTRACT

A cleaning apparatus includes a combing unit including a series of spaced protrusions or teeth extending into a cleaning roller for preventing build up and removing debris (such as hair, string, and the like). The protrusions extend along a substantial portion of the cleaning roller and extend partially into the cleaning roller to intercept the debris as it passes around the roller. The protrusions have angled leading edges that are not aligned with a rotation center of the cleaning
(Continued)

roller and are directed into or against a direction of rotation of the cleaning roller. The combing unit and protrusions have a shape and configuration designed to facilitate debris removal from the cleaning roller with minimal impact on the operation of the cleaning apparatus. The cleaning apparatus may include a surface cleaning head of an upright vacuum cleaner or sweeper or a robotic vacuum cleaner.

24 Claims, 14 Drawing Sheets

Related U.S. Application Data a continuation-in-part of application No. PCT/US2016/058148, filed on Oct. 21, 2016.

(60) Provisional application No. 62/469,853, filed on Mar. 10, 2017, provisional application No. 62/313,394, filed on Mar. 25, 2016, provisional application No. 62/248,813, filed on Oct. 30, 2015, provisional application No. 62/244,331, filed on Oct. 21, 2015.

(51) Int. Cl.

| | |
|---|---|
| ***A47L 5/26*** | (2006.01) |
| ***A47L 5/30*** | (2006.01) |
| ***A47L 9/30*** | (2006.01) |

(56) References Cited

U.S. PATENT DOCUMENTS

| | | | |
|---|---|---|---|
| 2,607,062 | A | 8/1952 | Le Febvre |
| 2,785,431 | A | 3/1957 | Pardee |
| 4,138,762 | A | 2/1979 | Jost et al. |
| 4,173,807 | A | 11/1979 | Maier |
| 4,333,205 | A | 6/1982 | Woodward et al. |
| 4,334,337 | A | 6/1982 | Miller et al. |
| 4,372,004 | A | 2/1983 | Vermillion |
| 4,627,127 | A | 12/1986 | Dupre |
| 4,662,027 | A | 5/1987 | Parker et al. |
| 4,912,805 | A | 4/1990 | Krasznai et al. |
| D348,548 | S | 7/1994 | Pino |
| 5,452,490 | A | 9/1995 | Brundula et al. |
| 5,495,634 | A | 3/1996 | Brundula et al. |
| 5,611,109 | A | 3/1997 | Worwag |
| 5,632,060 | A | 5/1997 | Steinberg et al. |
| 5,765,258 | A | 6/1998 | Melito et al. |
| 5,960,514 | A | 10/1999 | Miller et al. |
| 6,012,200 | A | 1/2000 | Murphy et al. |
| D440,019 | S | 4/2001 | Mehaffey et al. |
| 6,226,832 | B1 | 5/2001 | McCormick |
| 6,237,188 | B1 | 5/2001 | Takemoto et al. |
| D473,687 | S | 4/2003 | Kaffenberger |
| 6,550,099 | B2 | 4/2003 | Worwag |
| 7,013,528 | B2 | 3/2006 | Parker et al. |
| D524,498 | S | 7/2006 | Luebbering et al. |
| 7,171,723 | B2 | 2/2007 | Kobayashi et al. |
| 7,200,893 | B2 | 4/2007 | Gerber et al. |
| 7,316,050 | B2 | 1/2008 | Worwag |
| 7,328,479 | B2 | 2/2008 | Willenbring |
| 7,329,294 | B2 | 2/2008 | Conrad |
| D566,356 | S | 4/2008 | Medema |
| D569,564 | S | 5/2008 | Labarbera |
| D594,612 | S | 6/2009 | Umeda |
| D597,268 | S | 7/2009 | Santiago et al. |
| 7,690,079 | B2 | 4/2010 | Boddy et al. |
| D619,315 | S | 7/2010 | Ayers |
| 7,769,490 | B2 | 8/2010 | Abramson et al. |
| D635,728 | S | 4/2011 | Fjellman |
| 7,979,952 | B2 | 7/2011 | Beskow et al. |
| 8,037,571 | B2 | 10/2011 | Butts et al. |
| D655,468 | S | 3/2012 | Karsan |
| D668,010 | S | 9/2012 | Stickney et al. |
| 8,316,503 | B2 | 11/2012 | Follows et al. |
| 8,402,600 | B2 | 3/2013 | Beskow et al. |
| 8,402,601 | B2 | 3/2013 | Fahlstrom |
| D681,291 | S | 4/2013 | Morgan et al. |
| 8,418,303 | B2 | 4/2013 | Kapoor et al. |
| 8,631,541 | B2 | 1/2014 | Tran |
| 8,726,441 | B1 | 5/2014 | Colasanti et al. |
| 8,745,818 | B2 | 6/2014 | Iles et al. |
| 8,776,311 | B2 | 7/2014 | Genn et al. |
| 8,782,851 | B2 | 7/2014 | Follows et al. |
| 8,800,107 | B2 | 8/2014 | Blouin |
| 8,806,710 | B2 | 8/2014 | Follows et al. |
| D720,104 | S | 12/2014 | Santiago et al. |
| 9,021,655 | B2 | 5/2015 | Owen et al. |
| 9,027,198 | B2 | 5/2015 | Conrad |
| D731,130 | S | 6/2015 | Dyson et al. |
| D731,134 | S | 6/2015 | Dyson et al. |
| D731,136 | S | 6/2015 | Yun et al. |
| D731,720 | S | 6/2015 | Gidwell et al. |
| D731,724 | S | 6/2015 | Cheon et al. |
| 9,066,640 | B2 | 6/2015 | Iles et al. |
| D738,583 | S | 9/2015 | Gidwell et al. |
| D738,584 | S | 9/2015 | Niedzwecki |
| 9,144,356 | B2 | 9/2015 | Yun |
| D741,558 | S | 10/2015 | Kerr |
| D742,083 | S | 10/2015 | Gidwell et al. |
| D743,123 | S | 11/2015 | Chu |
| D745,231 | S | 12/2015 | Niedzwecki |
| D747,571 | S | 1/2016 | Dyson |
| D747,572 | S | 1/2016 | Kerr |
| 9,295,362 | B2 | 3/2016 | Eriksson |
| 9,314,140 | B2 | 4/2016 | Eriksson |
| D761,507 | S | 7/2016 | Heck et al. |
| D762,031 | S | 7/2016 | Niedzwecki |
| 9,451,853 | B2 | 9/2016 | Conrad et al. |
| D770,111 | S | 10/2016 | Lee et al. |
| 9,456,723 | B2 | 10/2016 | Thorne et al. |
| 9,468,346 | B1 | 10/2016 | Rzepka |
| D771,890 | S | 11/2016 | Kim |
| D772,512 | S | 11/2016 | Yoon et al. |
| D773,139 | S | 11/2016 | Palladino |
| D774,260 | S | 12/2016 | Manning |
| D774,264 | S | 12/2016 | Bartram et al. |
| D779,751 | S | 2/2017 | Chu |
| D779,752 | S | 2/2017 | Johnson |
| D781,014 | S | 3/2017 | Wu et al. |
| D788,393 | S | 5/2017 | Canas et al. |
| D789,007 | S | 6/2017 | Jang et al. |
| D790,785 | S | 6/2017 | Courtney et al. |
| D792,665 | S | 7/2017 | Salagnac |
| D796,134 | S | 8/2017 | Labarbera |
| D796,136 | S | 8/2017 | Reynolds et al. |
| 2002/0124334 | A1 | 9/2002 | Worwag |
| 2003/0106183 | A1 | 6/2003 | Frederick et al. |
| 2003/0145424 | A1 | 8/2003 | Stephens et al. |
| 2003/0159240 | A1 | 8/2003 | Mertes et al. |
| 2004/0045125 | A1 | 3/2004 | Park et al. |
| 2005/0172447 | A1 | 8/2005 | Roney et al. |
| 2006/0037170 | A1 | 2/2006 | Shimizu |
| 2006/0191097 | A1 | 8/2006 | Baumhakel |
| 2009/0229075 | A1 | 9/2009 | Eriksson |
| 2010/0107359 | A1 | 5/2010 | Yoo |
| 2010/0287717 | A1* | 11/2010 | Jang ..... A47L 9/009 15/41.1 |
| 2010/0306958 | A1 | 12/2010 | Follows et al. |
| 2011/0219571 | A1* | 9/2011 | Dyson ..... A47L 5/24 15/344 |
| 2011/0296648 | A1 | 12/2011 | Kah, Jr. |
| 2012/0000030 | A1 | 1/2012 | Conrad |
| 2012/0011676 | A1 | 1/2012 | Jung et al. |
| 2012/0169497 | A1* | 7/2012 | Schnittman ..... A47L 9/106 340/540 |
| 2012/0198644 | A1 | 8/2012 | Iles |
| 2012/0311802 | A1 | 12/2012 | Hinnant |
| 2012/0311813 | A1 | 12/2012 | Gilbert, Jr. et al. |
| 2013/0139349 | A1* | 6/2013 | Iles ..... A47L 9/0488 15/383 |
| 2013/0212831 | A1 | 8/2013 | Follows et al. |
| 2013/0298350 | A1 | 11/2013 | Schnittman et al. |

(56) References Cited

U.S. PATENT DOCUMENTS

| | | | | |
|---|---|---|---|---|
| 2014/0060577 | A1 | 3/2014 | Bruders et al. | |
| 2014/0150202 | A1 | 6/2014 | Schultheis | |
| 2014/0196247 | A1 | 7/2014 | Kasper et al. | |
| 2014/0237760 | A1 | 8/2014 | Conrad | |
| 2014/0259475 | A1 | 9/2014 | Doughty | |
| 2014/0259521 | A1 | 9/2014 | Kowalski | |
| 2015/0033498 | A1 | 2/2015 | McVey | |
| 2015/0289735 | A1* | 10/2015 | Van Der Kooi | A47L 9/02 15/383 |
| 2015/0359396 | A1 | 12/2015 | Yun | |
| 2016/0058257 | A1 | 3/2016 | Ventress et al. | |
| 2016/0220082 | A1 | 8/2016 | Thorne et al. | |
| 2016/0345795 | A1 | 12/2016 | Manning | |
| 2017/0079493 | A1 | 3/2017 | Genn et al. | |
| 2017/0127896 | A1 | 5/2017 | Carter et al. | |
| 2017/0215667 | A1 | 8/2017 | Thorne et al. | |
| 2017/0231445 | A1 | 8/2017 | Kasper | |
| 2017/0280957 | A1 | 10/2017 | Jeong et al. | |
| 2017/0332859 | A1 | 11/2017 | Nam et al. | |
| 2018/0199784 | A1 | 7/2018 | Schnittman et al. | |
| 2018/0255991 | A1 | 9/2018 | Der Marderosian et al. | |

FOREIGN PATENT DOCUMENTS

| | | | | |
|---|---|---|---|---|
| CN | 104138238 | | 11/2014 | |
| CN | 205181249 | U | 4/2016 | |
| CN | 206080407 | U | 4/2017 | |
| CN | 106963290 | | 7/2017 | |
| DE | 10302525 | A1 * | 5/2004 | A47L 5/30 |
| DE | 10302525 | | 10/2006 | |
| DE | 102010017211 | A1 | 12/2011 | |
| DE | 102010017258 | A1 | 12/2011 | |
| EP | 0042370 | A1 * | 6/1981 | A47L 11/32 |
| EP | 0042370 | | 12/1981 | |
| EP | 0909547 | A2 | 4/1999 | |
| EP | 1994869 | | 11/2008 | |
| EP | 2289381 | A2 | 3/2011 | |
| EP | 2218385 | A3 | 3/2013 | |
| EP | 2543301 | | 9/2013 | |
| EP | 3073881 | | 10/2016 | |
| EP | 3187083 | | 7/2017 | |
| GB | 360577 | | 11/1931 | |
| GB | 583738 | | 12/1946 | |
| GB | 877778 | A | 9/1961 | |
| GB | 2109224 | | 6/1983 | |
| GB | 228577 | A | 7/1995 | |
| GB | 2476811 | | 7/2011 | |
| GB | 2509925 | B | 7/2014 | |
| GB | 2529819 | | 9/2016 | |
| JP | S507359 | | 1/1975 | |
| JP | S59174143 | U | 11/1984 | |
| JP | 03228721 | A | 10/1991 | |
| JP | 05228083 | A | 9/1993 | |
| JP | H06248499 | A | 10/1994 | |
| JP | H07322981 | A | 12/1995 | |
| JP | 2639155 | B2 | 8/1997 | |
| JP | H10127542 | A | 5/1998 | |
| JP | H10201682 | A | 8/1998 | |
| JP | H11028178 | A | 2/1999 | |
| JP | H11187997 | A | 7/1999 | |
| JP | 2000033059 | A | 2/2000 | |
| JP | 2000139786 | | 5/2000 | |
| JP | 2001120473 | A | 5/2001 | |
| JP | 2003339589 | A | 12/2003 | |
| JP | 2004222912 | A * | 8/2004 | |
| JP | 2004222912 | A | 8/2004 | |
| JP | 2005046262 | A | 2/2005 | |
| JP | 2006247229 | A | 9/2006 | |
| JP | 2006312066 | A * | 11/2006 | |
| JP | 2006312066 | A | 11/2006 | |
| JP | 2007068835 | | 3/2007 | |
| JP | 2008000382 | | 1/2008 | |
| JP | 2008043351 | | 2/2008 | |
| JP | 2009045503 | A | 3/2009 | |
| JP | 2010246848 | | 11/2010 | |
| JP | 2011050428 | A | 3/2011 | |
| JP | 2011188951 | | 9/2011 | |
| JP | 2013013590 | A | 1/2013 | |
| JP | 2013052238 | A | 3/2013 | |
| JP | 2014033738 | A | 2/2014 | |
| JP | 2015000210 | | 1/2015 | |
| JP | 2015116414 | A | 6/2015 | |
| JP | 2016504100 | A | 2/2016 | |
| JP | 2017074258 | A | 4/2017 | |
| JP | 2017121468 | A | 7/2017 | |
| KR | 20040052092 | A | 6/2004 | |
| KR | 20050099416 | | 10/2005 | |
| KR | 100593324 | B1 | 6/2006 | |
| WO | 9210967 | A1 | 7/1992 | |
| WO | 0141618 | A1 | 6/2001 | |
| WO | 2009117383 | | 9/2009 | |
| WO | 2011083294 | A1 | 7/2011 | |
| WO | 2013104886 | A1 | 7/2013 | |
| WO | 2014131105 | A1 | 9/2014 | |
| WO | 2014131106 | A1 | 9/2014 | |
| WO | 2014177216 | | 11/2014 | |
| WO | 2015015166 | | 2/2015 | |
| WO | 2015015167 | | 2/2015 | |
| WO | 2015075481 | | 5/2015 | |
| WO | 2016034848 | | 3/2016 | |
| WO | 2017070492 | A1 | 4/2017 | |

OTHER PUBLICATIONS

International Search Report and Written Opinion dated Mar. 24, 2017 in corresponding PCT Patent Application No. PCT/US 16/58148, 14 pgs.

PCT Search Report and Written Opinion dated Dec. 26, 2018, received in PCT Application No. PCT/US18/47525, 14 pgs.

Australian Examination Report dated Oct. 23, 2018, received in AU Application No. 2016341998, 5 pgs.

Australian Examination Report dated Oct. 16, 2018, received in AU Application No. 2016342001, 5 pgs.

PCT Search Report and Written Opinion dated Aug. 23, 2018, received in PCT Application No. PCT/US18/34320, 11 pgs.

PCT Search Report and Written Opinion dated Jul. 18, 2018, received in PCT Application No. PCT/US18/28635, 16 pgs.

Extended European Search Report dated Mar. 28, 2019, received in EP Application No. 16858305.2, 7 pgs.

English translation of Japanese Office Action dated May 21, 2019, received in Japanese Application No. 2018-520541, 11 pgs.

English translation of Korean Office Action dated Apr. 30, 2019, received in Korean Application No. 10-2018-7014180, 11 pgs.

U.S. Office Action dated May 3, 2019, received in U.S. Appl. No. 15/331,045, 9 pgs.

Extended European Search Report dated Apr. 3, 2019, received in EP Application No. 16858308.6, 7 pgs.

English translation of Japanese Office Action dated Apr. 1, 2019, received in Japanese Application No. 2017-557189, 6 pgs.

English translation of Korean Office Action dated May 31, 2019, received in Korean Application No. 10-2018-7014186, 8 pgs.

Chinese Office Action with English translation dated Mar. 25, 2020, received in Chinese Patent Application No. 201711405708.5, 11 pgs.

U.S. Office Action dated Mar. 17, 2020, received in U.S. Appl. No. 15/768,879, 25 pgs.

English translation of Japanese Office Action dated Dec. 2, 2019, received in JP Application No. 2018-520541, 6 pgs.

English translation of Korean Office Action dated Nov. 27, 2019, received in Korean Application No. 10-2018-7014180, 5 pgs.

U.S. Office Action dated Sep. 17, 2019, received in U.S. Appl. No. 15/685,456, 11 pgs.

Chinese Office Action with English translation dated Jan. 2, 2020, received in Chinese Patent Application No. 201680061488.6, 11 pgs.

English translation of Japanese Decision of Rejection dated Jan. 6, 2020, received in Japanese Application No. 2017-557189, 5 pgs.

(56) References Cited

OTHER PUBLICATIONS

Chinese Office Action with English translation dated Feb. 25, 2020, received in Chinese Patent Application No. 201610921399.6, 18 pgs.
Chinese Office Action with English translation dated Mar. 2, 2020, received in Chinese Patent Application No. 201711481216.4, 16 pgs.
EP Search Report dated Nov. 27, 2020, received in EP Application No. 18806820.9, 7 pgs.
Australian Examination Report dated Jun. 24, 2021, received in Australian Patent Application No. 2021201452, 6 pages.
Chinese Decision of Rejection with English translation dated Jun. 8, 2021 received in Chinese Patent Application No. 201711405708.5, 6 pages.
Office Action dated May 3, 2021, received in Canadian Patent Application No. 3,073,677, 6 pages.
Japanese Office Action with English translation dated Jul. 9, 2021, received in Japanese Patent Application No. 2020-080880, 8 pages.
Australian Examination Report dated May 5, 2021, received in Australian Patent Application No. 2021201726, 3 pages.
Chinese Office Action with English translation dated Aug. 31, 2021, received in Chinese Patent Application No. 202011084724.0, 8 pages.
European Extended Search Report dated Jul. 13, 2021, received in European Patent Application No. 18848114.7, 5 pages.
Korean Office Action with English translation dated Aug. 2, 2021, received in Korean Patent Application No. 10-2020-7006909, 14 pages.
Chinese Office Action with English translation dated Dec. 9, 2020, received in Chinese Patent Application No. 201711405708.5, 7 pages.
Canadian Examiner Report dated Feb. 8, 2021, received in Canada Patent Application No. 3,064,747, 4 pages.
Korean Office Action with English translation dated Mar. 19, 2021, received in Korean Patent Application No. 10-2020-7006909, 15 pages.
Japanese Office Action with English translation dated Mar. 22, 2021, received in Japanese Patent Application No. 2020-510098, 15 pages.
Chinese Office Action with English translation dated Jan. 6, 2021, received in Chinese Patent Application No. 201711481216.4, 11 pages.
Japanese Office Action with English translation dated Jan. 26, received in Japanese Patent Application No. 2019-564874, 9 pages.
Chinese Office Action with English translation dated Apr. 13, 2021, received in Chinese Patent Application No. 201810516731.X, 13 pages.
Japanese Office Action with English translation dated Jan. 26, 2021, received in Japanese Patent Application No. 2019-556824, 11 pages.
Chinese Office Action with English translation, dated May 22, 2020, received in China Applicatin No. 201810965394.2, 20 pgs.
Chinese Office Action with English translation, dated May 26, 2020, received in China Application No. 201810516731.X, 13 pgs.
Korean Office Action with English translation, dated Aug. 31, 2020, received in Korean Application No. 10-2020-7018384, 7 pgs.
Chinese Office Action with English translation, dated Oct. 15, 2020, received in China Application No. 201610921399.6, 21 pgs.
Australian Examination Report dated Jun. 11, 2020, received in Australian Application No. 2019246800, 7 pgs.
European Search Report dated Nov. 27, 2020, received in EP Application No. 18806820.9, 7 pgs.
U.S. Office Action dated May 21, 2020, received in U.S. Appl. No. 15/331,045, 14 pgs.
U.S. Office Action dated Nov. 2, 2020, received in U.S. Appl. No. 15/987,589, 15 pgs.
Japanese Office Action with English translation, dated Jan. 21, 2021, received in JP Application No. 2017-557189, 27 pgs.
Chinese Decision of Rejection dated May 7, 2021, received in China Application No. 201680061488.6, 9 pgs.
Chinese Office Action with English translation, dated Jul. 31, 2020, received in China Application No. 201610921399.6, 21 pgs.
PCT International Search Report and Written Opinion dated Mar. 31, 2016, received in corresponding PCT Application No. PCT/US16/15370, 15 pgs.
3rd Party Observation filed Jul. 13, 2020 in EP Application No. 20160744107, 7 pgs.
U.S. Office Action dated Feb. 22, 2016, received in related U.S. Appl. No. 14/744,438, 29 pgs.
Japanese Office Action with English translation dated Apr. 22, 2022, received in Japanese Application No. 2021-521415, 13 pages.
Chinese Office Action with English translation dated Feb. 18, 2022, received in Chinese Application No. 202110712842.X, 13 pages.
UK Examination Report dated Mar. 30, 2022, received in UK Application No. GB191515.4, 5 pages.
Australian Examination Report dated Mar. 17, 2022, received in Australian Application No. 2019362030, 3 pages.
Korean Office Action with machine translation dated Jan. 18, 2022, received in Korean Patent Application No. 10-2019-7034239, 10 pages.
UK Examination Report dated Sep. 20, 2022, received in UK Patent Application No. 1915155.4, 4 pages.
UK Examination Report dated Oct. 24, 2022, received in UK Patent Application No. 2212062.0, 4 pages.
U.S. Office Action dated Oct. 20, 2022, received in U.S. Appl. No. 16/656,930, 11 pages.
Chinese Office Action with English translation dated Oct. 18, 2022, received in Chinese Patent Application No. 202210128813.3, 14 pages.
Australian Examination Report dated Nov. 15, 2022, received in Australian Patent Application No. 2021232679, 5 pages.
Extended European Search Report dated Jun. 17, 2022, received in European Patent Application No. 19872356.1, 6 pages.
Chinese Office Action with English Machine Translation dated Jun. 28, 2022, received in Chinese Patent Application No. 202111186082.X, 14 pages.
Chinese Office Action with English Translation dated Jun. 24, 2022, received in Chinese Patent Application No. 2019800688188, 16 pages.
Korean Office Action with English Machine Translation dated Aug. 1, 2022, received in Korean Patent Application No. 10-2021-7014906, 12 pages.
Chinese Office Action with English Machine Translation dated Aug. 10, 2022, received in Chinese Patent Application No. 202110712842.X, 20 pages.
Canadian Office Action dated Jul. 25, 2022, received in Canadian Patent Application No. 3,117,040, 3 pages.
Chinese Office Action with English summary dated Dec. 26, 2022, received in Chinese Patent Application No. 202210063972X, 10 pages.
U.S. Office Action dated Feb. 23, 2023, received in U.S. Appl. No. 17/556,992, 14 pages.

* cited by examiner

CLEANING APPARATUS WITH COMBING UNIT FOR REMOVING DEBRIS FROM CLEANING ROLLER

CROSS-REFERENCE TO RELATED APPLICATIONS

The present application claims the benefit of U.S. Provisional Application No. 62/469,853, filed Mar. 10, 2017 and is a continuation-in-part of U.S. patent application Ser. No. 15/331,045, filed Oct. 21, 2016, which claims the benefit of U.S. Provisional Patent Application Ser. No. 62/244,331 filed Oct. 21, 2015, U.S. Provisional Patent Application Ser. No. 62/248,813 filed Oct. 30, 2015, and U.S. Provisional Patent Application Ser. No. 62/313,394 filed Mar. 25, 2016, all of which are fully incorporated herein by reference. The present application is also a continuation-in-part of International Application No. PCT/US2016/058148, filed on Oct. 21, 2016, which is fully incorporated herein by reference.

TECHNICAL FIELD

The present disclosure relates to cleaners with cleaning rollers and more particularly, to a cleaning apparatus, such as a surface cleaning head for a vacuum cleaner, with a combing unit for removing debris from a cleaning roller such as a leading roller.

BACKGROUND INFORMATION

Vacuum cleaners generally include a suction conduit with an opening on the underside of a surface cleaning head for drawing air (and debris) into and through the surface cleaning head. One of the challenges with vacuum cleaner design is to control engagement of the suction conduit with a surface being cleaned to provide the desired amount of suction. If the suction conduit is spaced too far from a surface, the suction may be less because the air is flowing into the suction conduit through a greater surface area. If the suction conduit is directly engaged with the surface and thus sealed on all sides, air will stop flowing into the suction conduit and the suction motor may be damaged as a result.

Vacuum cleaners also generally use agitation to loosen debris and facilitate capturing the debris in the flow of air into the suction conduit. Agitators are often used in the suction conduit of a surface cleaning head proximate a dirty air inlet to cause the agitated debris to flow into the dirty air inlet. If the agitator in the suction conduit is unable to loosen the debris or if the debris is too small, the suction conduit may pass over the debris without removing the debris from the surface. In other cases, the surface cleaning head may push larger debris forward without ever allowing the debris to be captured in the flow into the suction conduit (sometimes referred to as snowplowing).

One example of an agitator is a cleaning roller such as a brush roll. A cleaning roller may be located within a suction conduit and/or may be located at a leading side of a suction conduit (e.g., a leading roller). One challenge with a leading roller in particular is the debris (e.g., hair) that becomes entangled around the roller. Projections may be used to engage the roller to facilitate removal of debris, but existing structures are often not effective and/or interfere with the operation of the surface cleaning head.

SUMMARY

Consistent with an embodiment, a cleaning apparatus includes a housing defining an opening on an underside of the housing for receiving debris, a cleaning roller mounted in the housing for directing debris into the opening, and a combing unit extending a substantial length of a cleaning surface of the cleaning roller and in contact with the cleaning roller. The combing unit includes a series of spaced combing protrusions extending partially into the cleaning roller and having angled leading edges that are not aligned with a center of rotation of the cleaning roller. The angled leading edges are directed into a direction of rotation of the cleaning roller.

Consistent with another embodiment, a surface cleaning head includes a housing having a front side and back side. The housing defines a suction conduit with an opening on an underside of the housing between the front side and the back side. A brush roll is rotatably mounted to the housing within the suction conduit and at least a portion of the brush roll is proximate the opening of the suction conduit. A leading roller is mounted to the housing in front of the brush roll and adjacent the opening of the suction conduit. A front portion of the leading roller is at least partially exposed at the front side of the housing. The surface cleaning head also includes a combing unit extending a substantial length of a cleaning surface of the leading roller and in contact with the leading roller. The combing unit includes a series of spaced combing protrusions extending partially into the leading roller and having angled leading edges that are not aligned with a center of rotation of the leading roller. The angled leading edges are directed toward a direction of rotation of the leading roller.

BRIEF DESCRIPTION OF THE DRAWINGS

These and other features and advantages will be better understood by reading the following detailed description, taken together with the drawings wherein.

DETAILED DESCRIPTION

Figure 1:
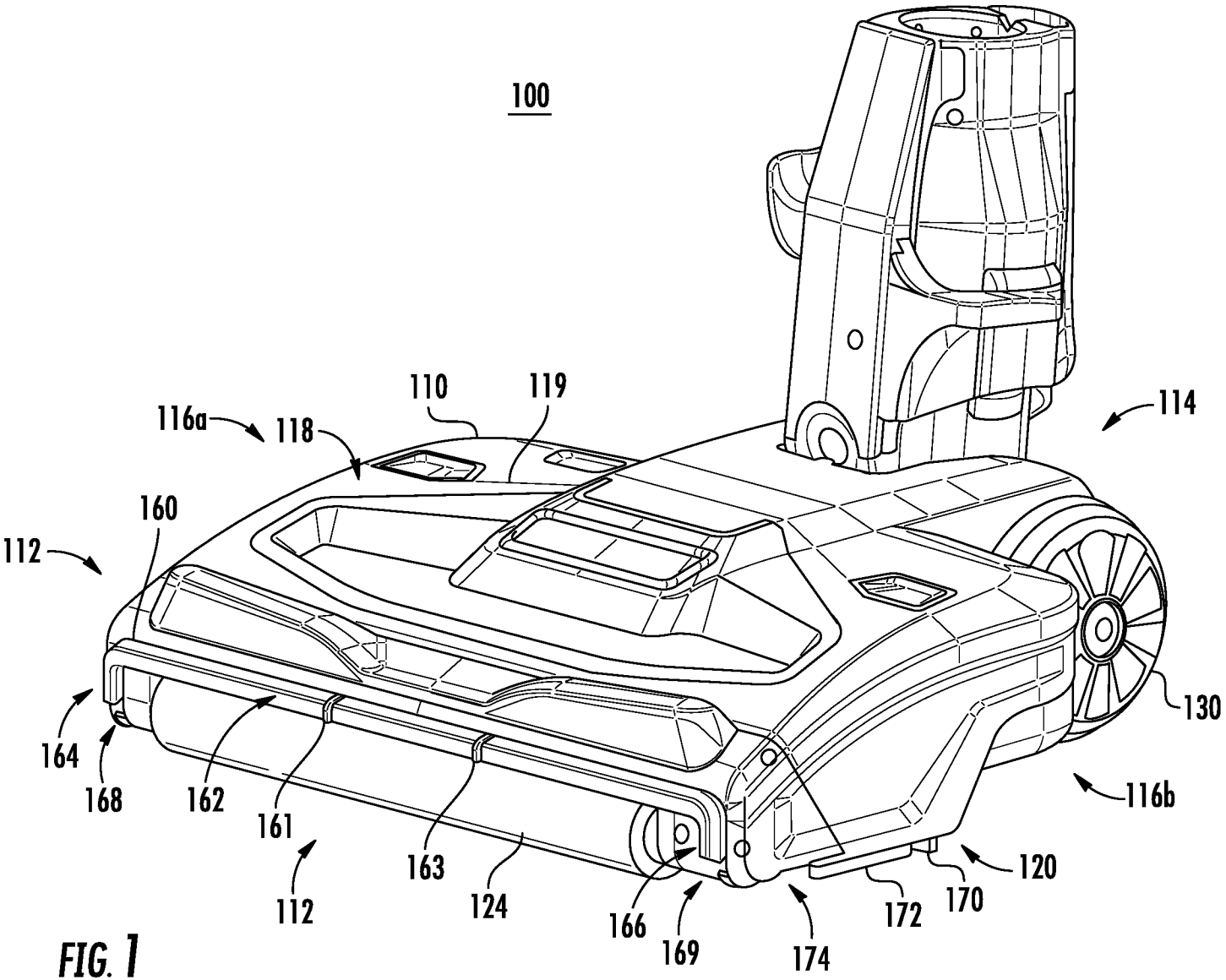
FIG. 1 is a perspective view of a surface cleaning head including dual agitators and combing protrusions, consistent with an embodiment of the present disclosure.
Figure 2:
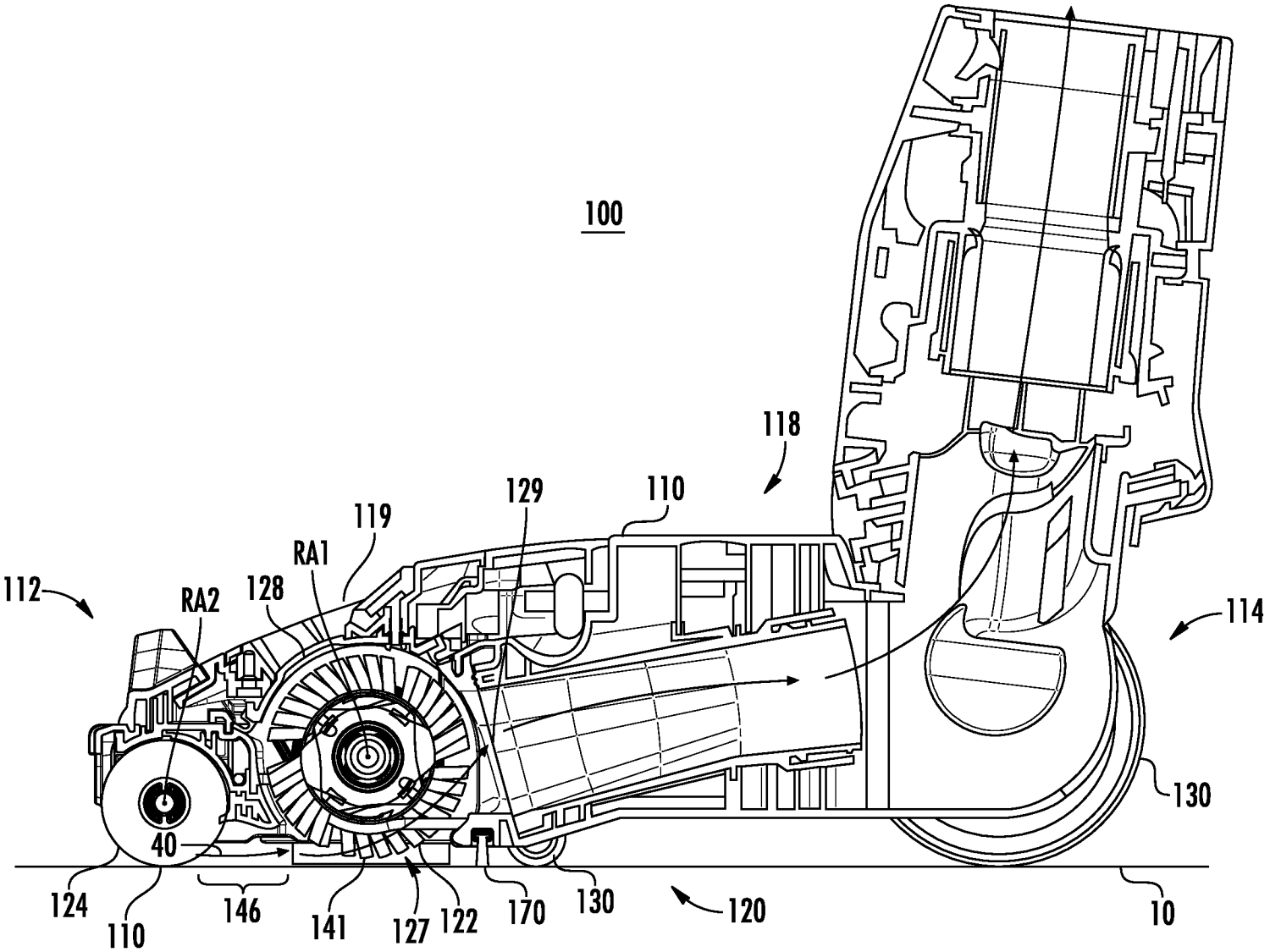
FIG. 2 is a side cross-sectional view of the surface cleaning head shown in FIG. 1 showing a flow path through a suction conduit.

A cleaning apparatus, consistent with embodiments of the present disclosure, includes a combing unit (also referred to as a debriding unit or rib) including a series of spaced protrusions or teeth extending into a cleaning roller for preventing build up and removing debris (such as hair, string, and the like). The protrusions extend along a substantial portion of the cleaning roller and extend partially into the cleaning roller to intercept the debris as it passes around the roller. The protrusions have angled leading edges that are not aligned with a rotation center of the cleaning roller and are directed into or against a direction of rotation of the cleaning roller. The combing unit and protrusions have a shape and configuration designed to facilitate debris removal from the cleaning roller with minimal impact on the operation of the cleaning apparatus. The cleaning apparatus may include a surface cleaning head of an upright vacuum cleaner or sweeper or a robotic vacuum cleaner.

An embodiment of a surface cleaning head may include dual rotating agitators (e.g., a leading roller and a brush roll) and may be used to facilitate capturing of debris in the air flow into a suction conduit on the underside of the surface cleaning head. In this embodiment, the leading roller is generally positioned adjacent to and in advance of the opening of the suction conduit such that the leading roller engages debris and moves the debris toward the opening. At least a top half of the leading roller may be substantially outside of the flow path to the suction conduit and a bottom portion of the leading roller may be exposed to the flow path to the suction conduit. The rotating brush roll may be located in the suction conduit with the leading roller located in front of and spaced from the brush roll, forming an inter-roller air passageway between lower portions of the leading roller and the brush roll. In some embodiments, combing protrusions may contact the leading roller above the inter-roller air passageway to facilitate debris removal into the flow path. The surface cleaning head may also include a leading bumper that extends in front of the leading roller to protect a front portion of the leading roller and facilitate front edge cleaning.

Although specific embodiments of a surface cleaning head with a leading roller are shown, other embodiments of a cleaning apparatus with a combing unit are within the scope of the present disclosure. The cleaning apparatus with the combing unit may be used in different types of vacuum cleaners including, without limitation, an "all in the head" type vacuum, upright vacuum cleaners, canister vacuum cleaners, stick vacuum cleaners, robotic vacuum cleaners and central vacuum systems, and may be used in sweepers (e.g., low or no suction). The surface cleaning head with a leading roller may also include removable agitators (e.g., brush rolls) in openable agitator chambers, such as the type described in greater detail in U.S. Pat. No. 9,456,723 and U.S. Patent Application Pub. No. 2016/0220082, which are commonly-owned and fully incorporated herein by reference. The leading roller may be similarly removable.

As used herein, a "surface cleaning head" refers to a device configured to contact a surface for cleaning the surface by use of suction air flow, agitation, or a combination thereof. A surface cleaning head may be pivotably or steeringly coupled by a swivel connection to a wand for controlling the surface cleaning head and may include motorized attachments as well as fixed surface cleaning heads. A surface cleaning head may also be operable without a wand or handle. As used herein, "seal" or "sealing" refers to preventing a substantial amount of air from passing through to the suction conduit but does not require an air tight seal. As used herein, "agitator" refers to any element, member or structure capable of agitating a surface to facilitate movement of debris into a suction air flow in a surface cleaning head. As used herein, "soft" and "softer" refer to the characteristics of a cleaning element being more compliant or pliable than another cleaning element. As used herein, the term "flow path" refers to the path taken by air as it flows into a suction conduit when drawn in by suction. As used herein, the terms "above" and "below" are used relative to an orientation of the surface cleaning head on a surface to be cleaned and the terms "front" and "back" are used relative to a direction that a user pushes the surface cleaning head on a surface being cleaned (i.e., back to front). As used herein, the term "leading" refers to a position in front of at least another component but does not necessarily mean in front of all other components.

Referring to FIGS. 1-9, an embodiment of a surface cleaning head 100 with dual agitators and a combing unit is shown and described. The surface cleaning head 100 includes a housing 110 with a front side 112, and a back side 114, left and right sides 116*a*, 116*b*, an upper side 118, and a lower or under side 120. The housing 110 defines a suction conduit 128 having an opening 127 on the underside 120 of the housing (shown in FIGS. 2 and 3). The suction conduit 128 is fluidly coupled to a dirty air inlet 129, which leads to a suction motor (not shown) either in the surface cleaning head 100 or another location in the vacuum. The suction conduit 128 is the interior space defined by interior walls in the housing 110, which receives and directs air drawn in by suction, and the opening 127 is where the suction conduit 128 meets the underside 120 of the housing 110.

The surface cleaning head 100 includes dual rotating agitators 122, 124, for example, a brush roll 122 and a leading roller 124. The brush roll 122 and leading roller 124 may be configured to rotate about first and second rotating axes (RA1, RA2). The rotating brush roll 122 is at least partially disposed within the suction conduit 128 (shown in FIGS. 2 and 3). The leading roller 124 is positioned in front of and spaced from the brush roll 122 and at least substantially outside the suction conduit 128. In some embodiments, at least an inside upper portion (e.g., upper half) of the leading roller 124 is not exposed to the primary air flow path (e.g., arrow 40) into the opening 127 of the suction conduit 128 while at least an inside of the bottom portion of the leading roller 124 is exposed to the primary flow path into the opening 127 of the suction conduit 128.

Other variations are possible where different portions of the leading roller 124 may be exposed or not exposed to the flow path into the suction conduit 128. In other embodiments, for example, a flow path may allow air to flow over the upper portion of the leading roller 124. The leading roller 124 may rotate about the second rotation axis RA2 located within a leading roller chamber 126. The leading roller chamber 126 may have a size and shape slightly larger than the cylindrical projection of the leading roller 124 when the leading roller 124 is rotating therein, for example, to form the flow path over the upper portion.

The surface cleaning head 100 may include one or more wheels 130 for supporting the housing on the surface 10 to be cleaned. The brush roll 122 may be disposed in front of one or more wheels 130, 132 (see FIGS. 1 and 9) for supporting the housing 110 on the surface 10 to be cleaned. For example, one or more larger wheels 130 may be disposed along the back side 114 and/or one or more smaller middle wheels 132 may be provided at a middle section on the underside 116 of the housing 110 and/or along the left and right sides 116*a*, 116*b*. Other wheel configurations may also be used. The wheels 130, 132 facilitate moving the surface cleaning head 100 along the surface 10 to be cleaned, and may also allow the user to easily tilt or pivot the surface cleaning head 100 (e.g., brush roll 122 and/or the leading roller 124) off of the surface 10 to be cleaned. The rear wheel(s) 130 and the middle wheel(s) 132 may provide the primary contact with the surface being cleaned and thus primarily support the surface cleaning head 100. When the surface cleaning head 100 is positioned on the surface 10 being cleaned, the leading roller 124 may also rest on the surface 10 being cleaned. In other embodiments, the leading roller 124 may be positioned such that the leading roller 124 sits just above the surface being cleaned.

The rotating brush roll 122 may have bristles, fabric, or other cleaning elements, or any combination thereof around the outside of the brush roll 122. Examples of brush rolls and other agitators are shown and described in greater detail in U.S. Pat. No. 9,456,723 and U.S. Patent Application Pub. No. 2016/0220082, which are fully incorporated herein by reference.

The leading roller 124 may include a relatively soft material (e.g., soft bristles, fabric, felt, nap or pile) arranged in a pattern (e.g., a spiral pattern) to facilitate capturing debris, as will be described in greater detail below. The leading roller 124 may be selected to be substantially softer than that of the brush roll 122. The softness, length, diameter, arrangement, and resiliency of the bristles and/or pile of the leading roller 124 may be selected to form a seal with a hard surface (e.g., but not limited to, a hard wood floor, tile floor, laminate floor, or the like), whereas the bristles of the brush roll 122 may selected to agitate carpet fibers or the like. For example, the leading roller 124 may be at least 25% softer than the brush roll 122, alternatively the leading roller 124 may be at least 30% softer than the brush roll 122, alternatively the leading roller 124 may be at least 35% softer than the brush roll 122, alternatively the leading roller 124 may be at least 40% softer than the brush roll 122, alternatively the leading roller 124 may be at least 50% softer than the brush roll 122, alternatively the leading roller 124 may be at least 60% softer than the brush roll 122. Softness may be determined, for example, based on the pliability of the bristles or pile being used.

The size and shape of the bristles and/or pile may be selected based on the intended application. For example, the leading roller 124 may include bristles and/or pile having a length of between 5 to 15 mm (e.g., 7 to 12 mm) and may have a diameter of 0.01 to 0.04 mm (e.g., 0.01-0.03 mm). According to one embodiment, the bristles and/or pile may have a length of 9 mm and a diameter of 0.02 mm. The bristles and/or pile may have any shape. For example, the bristles and/or pile may be linear, arcuate, and/or may have a compound shape. According to one embodiment, the bristles and/or pile may have a generally U and/or Y shape. The U and/or Y shaped bristles and/or pile may increase the number of points contacting the floor surface 10, thereby enhancing sweeping function of leading roller 124. The bristles and/or pile may be made on any material such as, but not limited to, Nylon 6 or Nylon 6/6.

Optionally, the bristles and/or pile of leading roller 124 may be heat treated, for example, using a post weave heat treatment. The heat treatment may increase the lifespan of the bristles and/or pile of the leading roller 124. For example, after weaving the fibers and cutting the velvet into rolls, the velvet may be rolled up and then run through a steam rich autoclave making the fibers/bristles more resilient fibers.

The leading roller 124 may have an outside diameter Dlr that is smaller than the outside diameter Dbr of the brush roll 122. For example, the diameter Dlr may be greater than zero and less than or equal to 0.8 Dbr, greater than zero and less than or equal to 0.7 Dbr, or greater than zero and less than or equal to 0.6 Dbr. According to example embodiments, the diameter Dlr may be in the range of 0.3 Dbr to 0.8 Dbr, in the range of 0.4 Dbr to 0.8 Dbr, in the range of 0.3 Dbr to 0.7 Dbr, or in the range of 0.4 Dbr to 0.7 Dbr. As an illustrative example, the brush roll 122 may have an outside diameter of 48 mm and the leading roller 124 may have an outside diameter of 30 mm. While the leading roller 124 may have an outside diameter Dlr that is smaller than the outside diameter Dbr of the brush roll 122, the brush roll 122 may have bristles that are longer than the bristle and/or pile of the leading roller 122.

Positioning a leading roller 124 (having a diameter Dlr that is smaller than the diameter Dbr of the brush roll 122) in front of the brush roll 122 provides numerous benefits. For example, this arrangement decreases the height of the front side 112 of the surface cleaning head 100 (e.g., the housing 110) from the surface 10 to be cleaned. The decreased height of the front of the surface cleaning head 100 provides a lower profile that allows the surface cleaning head 100 to fit under objects (e.g., furniture and/or cabinets). Moreover, the lower height allows for the addition of one or more light sources 111 (such as, but not limited to, LEDs), while still allowing the surface cleaning head 100 to fit under objects.

Additionally, the smaller diameter Dlr of the leading roller 124 allows the rotating axis of the leading roller 124 to be placed closer to the front side 112 of the surface cleaning head 100. When rotating, the leading roller 124 forms a generally cylindrical projection having a radius that is based on the overall diameter of the leading roller 124. As the diameter of the leading roller 124 decreases, the bottom contact surface 140 (FIG. 3) of the leading roller 124 moves forward towards the front side 112 of the surface cleaning head 100. In addition, when the surface cleaning head 100 contacts a vertical surface 12 (e.g., but not limited to, a wall, trim, and/or cabinet), the bottom contact surface 140 of the leading roller 124 is also closer to the vertical surface 12, thereby enhancing the front edge cleaning of the surface cleaning head 100 compared to a larger diameter leading roller. Moreover, the smaller diameter Dlr of the leading roller 124 also reduces the load/drag on the motor driving the leading roller 124, thereby enhancing the lifespan of the motor and/or allowing a smaller motor to be used to rotate both the brush roll 122 and leading roller 124.

The rotating brush roll 122 may be coupled to an electrical motor (either AC or DC) to cause the rotating brush roll 122 to rotate about the first rotating axis. The rotating brush roll may be coupled to the electrical motor by way of a gears and/or drive belts. The leading roller 124 may be driven from the same drive mechanism used to drive the rotating brush roll 122 or a separate drive mechanism. An example of the drive mechanism is described in U.S. patent application Ser. No. 15/331,045, filed Oct. 21, 2016, which is incorporated herein by reference. Other drive mechanisms are possible and within the scope of the present disclosure.

Figure 3:
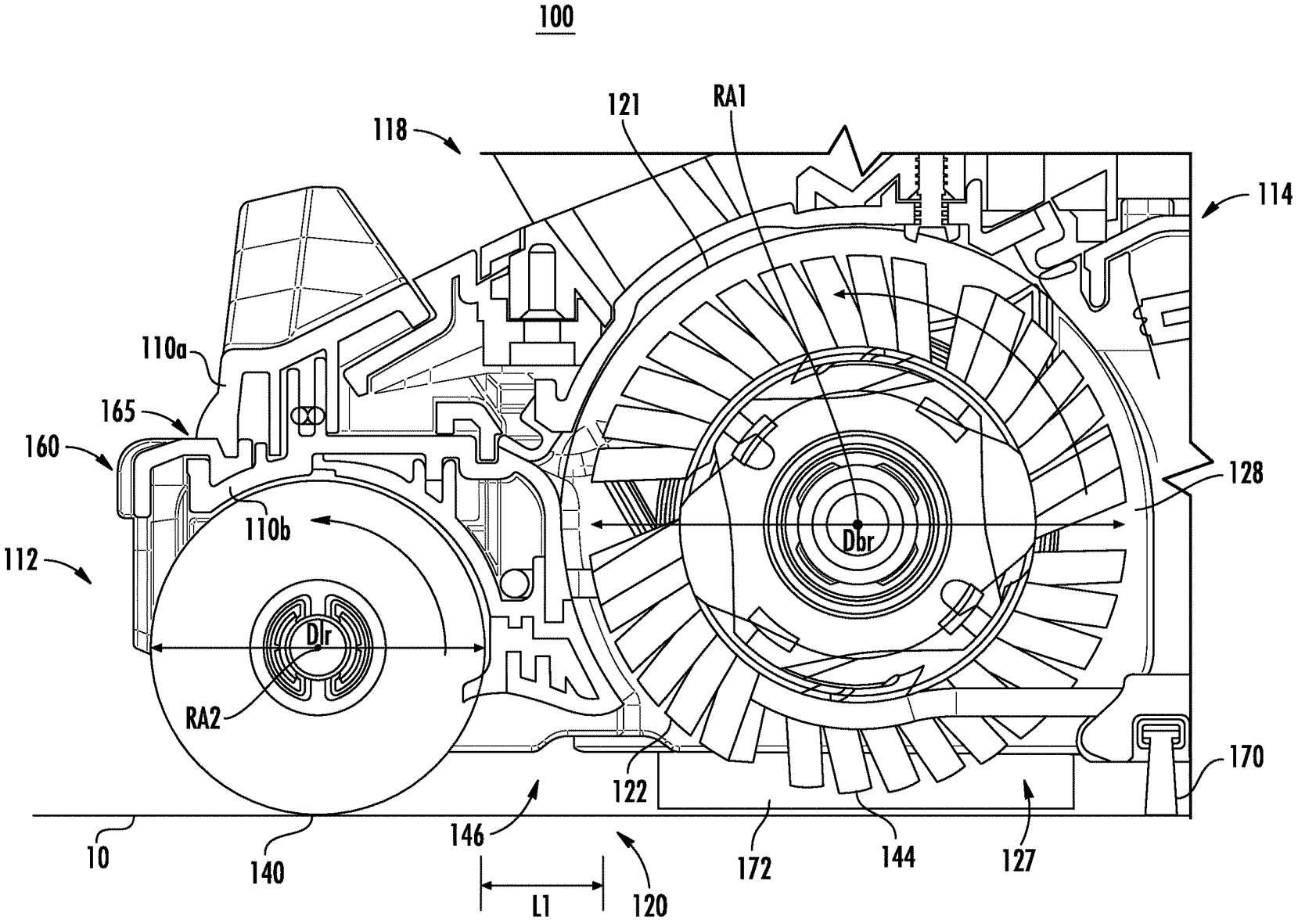
FIG. 3 is an enlarged side cross-sectional view illustrating the leading roller and brush roll of the surface cleaning head shown in FIG. 1.

In at least one embodiment, the brush roll 122 and the leading roller 124 rotate in the same direction directing debris toward the suction conduit 128, for example, counter clockwise as shown in FIG. 3. This arrangement may reduce the number of parts (e.g., no clutch or additional gear train may be necessary), thereby making the surface cleaning head 100 lighter, reducing drivetrain loss (thereby allowing for smaller/less expensive motors), and less expensive to manufacture. Optionally, the brush roll 122 and the leading roller 124 may rotate at same speed, thereby reducing the number of parts (e.g., no additional gear train necessary) and reducing drivetrain loss (thus, smaller/less expensive motor) and making the surface cleaning head 100 lighter and less expensive to manufacture.

As shown in FIG. 3, the leading roller 124 may be positioned within the housing 110 such that the bottom contact surface 140 is disposed closer to the surface 10 to be cleaned compared to the bottom contact surface 144 of the brush roll 122. This arrangement allows the leading roller 124 to contact a surface 10 (e.g., a hard surface) without the brush roll 122 contacting the hard surface 10. As may be appreciated, the leading roller 124 is intended to pick up debris from a hard surface 10 while the brush roll 122 is intended to primarily contact a carpet surface. This arrangement is therefore beneficial since it allows the leading roller 124 to form a seal between the front 112 of the surface cleaning head 100 with the hard surface 10, thereby enhancing airflow and suction with the hard surface 10. Additionally, this arrangement reduces the drag/torque on the drive motor(s) since the brush roll 122 (in some embodiments) does not have to contact the hard surface 10. The reduced drag/torque may allow for a smaller, less expensive motor and/or may increase the lifespan of the motor.

According to some embodiments, as shown in FIG. 3, the leading roller 124 is spaced apart a distance L1 (which is greater than 0 mm) from the brush roll 122 such that the leading roller 124 does not contact the brush roll 122. The distance L1 allows for an inter-roller vacuum passageway 146 between lower portions of the brush roll 122 and the leading roller 124, which provides at least a portion of the flow path into the opening 127 of the suction conduit 128. The inter-roller vacuum passageway 146 allows for debris that is either picked up by (and/or removed from) the leading roller 124 to be entrained in the vacuum flow generated by the surface cleaning head 100 and/or to be picked up by the brush roll 122, thereby enhancing the cleaning efficiency of the surface cleaning head 100. Additionally, the distance L1 reduces the load/drag on the motor(s), thereby enhancing the lifespan of the motor(s) and/or allowing smaller motors to be used to rotate both the brush roll 122 and the leading roller 124.

One or both of the leading roller 124 and the brush roll 122 may be removable. The leading roller 124 may be removably coupled to the housing 110 of the surface cleaning head 100. For example, a portion of the housing 110 (such as, but not limited to, a portion of the left and/or right side 116*a*, 116*b*) may be removably/hingedly coupled thereto. To remove the leading roller 124, the removable portion may be unsecured/uncoupled from the rest of the housing 110, thereby allowing the leading roller 124 to disengage from a drive wheel and allowing the leading roller 124 to be removed from the leading roller chamber 126. Other ways of removably coupling the leading roller 124 within the housing 110 are also possible and within the scope of the present disclosure.

In some embodiments, the housing 110 of the surface cleaning head 100 may include a removable and/or hinged panel that allows the brush roll 122 to be removed. A shown in FIGS. 1 and 8, for example, the surface cleaning head 100 includes a panel 119 that may be removably and/or hingedly coupled to the housing 110. To remove the brush roll 122, the panel 119 may be disengaged from the housing 110 (e.g., removed) to allow the user to have access to a brush roll chamber 121. Examples of removable panels or covers and removable brush rolls are described in greater detail in U.S. Pat. No. 9,456,723 and U.S. patent application Pub. No. 2016/0220082, which are fully incorporated herein by reference. Alternatively or additionally, the leading roller 124 may be removable in the same way. Another example of a removable leading roller is described in U.S. patent application Ser. No. 15/331,045, filed Oct. 21, 2016, which is incorporated herein by reference.

The ability to remove the brush roll 122 and/or the leading roller 124 from the surface cleaning head 100 allows the brush roll 122 and/or the leading roller 124 to be cleaned more easily and may allow the user to change the size of the brush roll 122 and/or the leading roller 124, change type of bristles on the brush roll 122 and/or the leading roller 124, and/or remove the brush roll 122 and/or the leading roller 124 entirely depending on the intended application.

In some embodiments, the surface cleaning head 100 may also include a series of combing protrusions 150 (also referred to as debriding protrusions) in contact with the leading roller 124, as shown in greater detail in FIGS. 4-7. The combing protrusions 150 may be configured to remove debris (such as, but not limited to, hair, string, and the like) that may be wrapped around and/or entrapped/entrained in/on the leading roller 124 as the surface cleaning head 100 is being used (e.g., without the user having to manually remove the debris from the leading roller 124). According to one embodiment, the combing protrusions 150 may contact only the leading roller 124 (e.g., the combing protrusions 150 may not contact the brush roll 122). Some of the benefits of the combing protrusions 150 only contacting the leading roller 124 include increasing the lifespan of the leading roller 124. Additionally, the combing protrusions 150 that only contact the leading roller 124 may reduce the load/drag on the motor, thereby allowing a smaller/less expensive motor to be used and making the surface cleaning head 100 lighter and less expensive to manufacture.

In this embodiment, the combing protrusions 150 may include a plurality of spaced ribs 152 with angled edges 153 extending into contact with a surface of the leading roller 124. The spaced ribs 152 extend from a back support 151 with base portions 154 located therebetween to reinforce the spaced ribs 152. The back support 151 may be mounted within the leading roller chamber 126. The angled edges 153 of the spaced ribs 152 may be arranged at an angle A (see FIGS. 4 and 6) that is in the range of 15-20 degrees, for example, 20-25 degrees, such as 23.5 degrees. This example structure of the combing protrusions 150 may allow for increased strength and reduced frictional loses since less points may contact the leading roller 124. Other shapes and configurations for the combing protrusions are also within the scope of the present disclosure.

Figure 4:
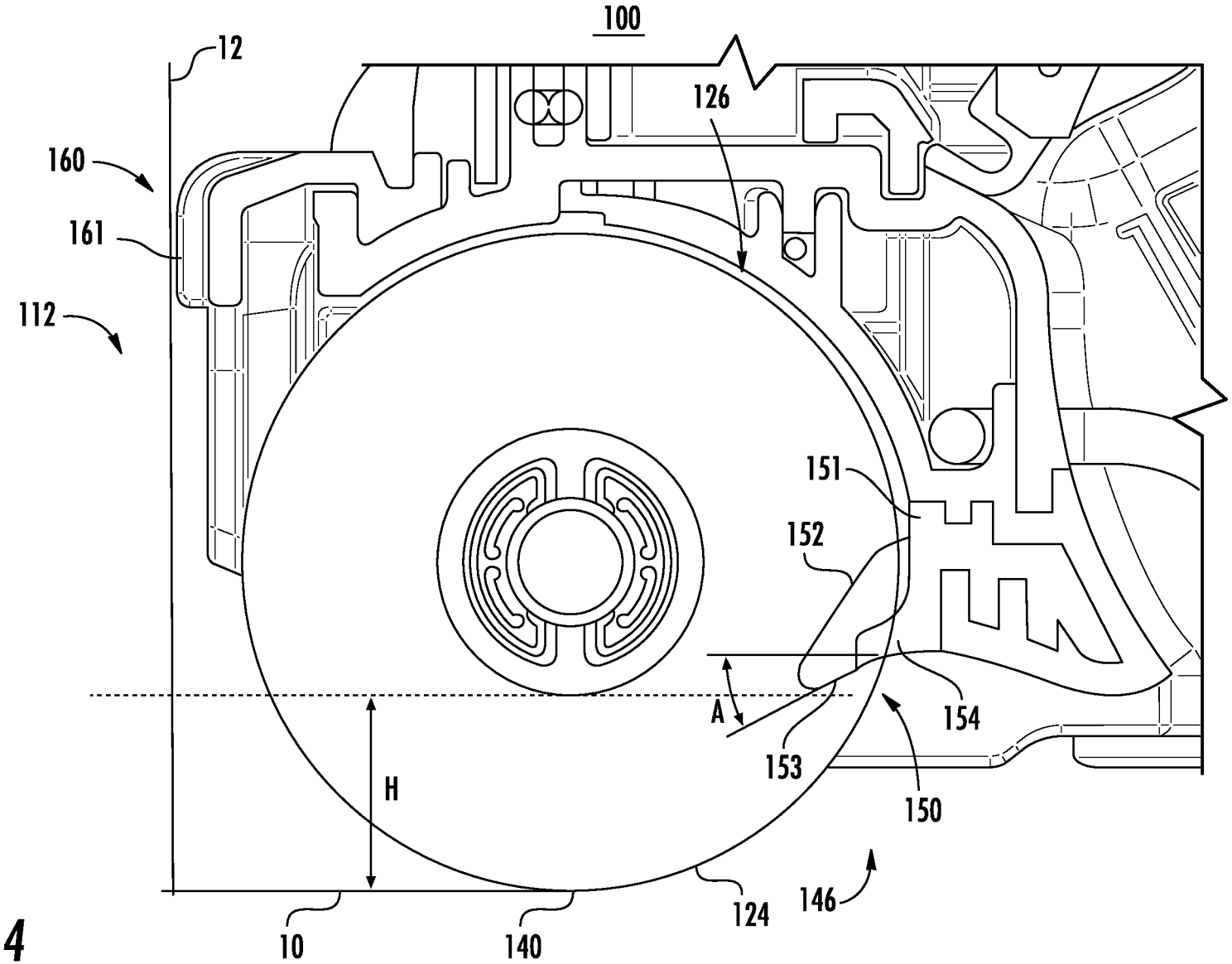
FIG. 4 is an enlarged side cross-sectional view illustrating a leading roller and combing protrusions in the surface cleaning head shown in FIG. 1.
Figure 5:
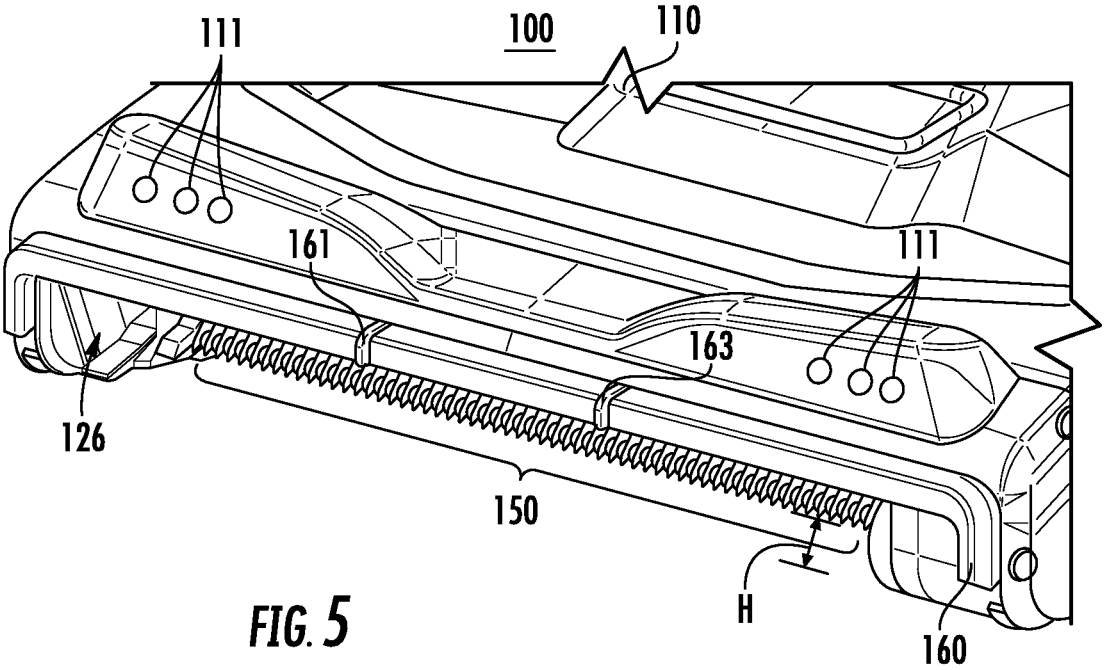
FIG. 5 is a front perspective view of the front region of the surface cleaning head of FIG. 1 without the leading roller and illustrating the combing protrusions.
Figure 6:
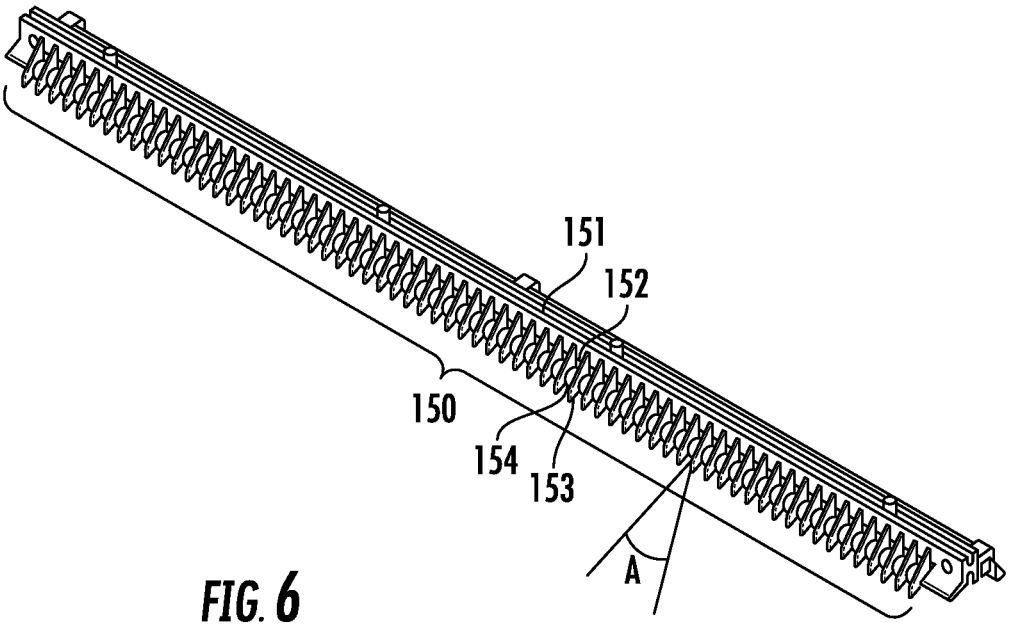
FIG. 6 is an enlarged perspective view of one embodiment of a plurality of combing protrusions.

As shown in FIGS. 4 and 5, the combing protrusions 150 may be disposed at a height H above the bottom contacting surface 140 of the leading roller 124 and on a side or lower half of the leading roller 124. The placement of the combing protrusions 150 may help to prevent the combing protrusions 150 from contacting a carpet, thereby reducing drag on the surface cleaning head 100 and reducing the likelihood of the combing protrusions 150 damaging the carpet. This arrangement also allows the combing protrusions 150 to be exposed to the inter-roller vacuum passageway 146, thereby enhancing the removal of debris from the leading roller 124 by the combing protrusions 150. The combing protrusion 150 may also substantially prevent air from flowing through the combing protrusions 150 to the inside upper portion (e.g., upper half) of the leading roller 124. In other embodiments, a space may be formed between the outer surface of the leading roller 124 and the back support 151 such that air flows downward through the combing protrusions 150 to force debris into the air flow through the inter-roller vacuum passageway 146.

Figure 7:
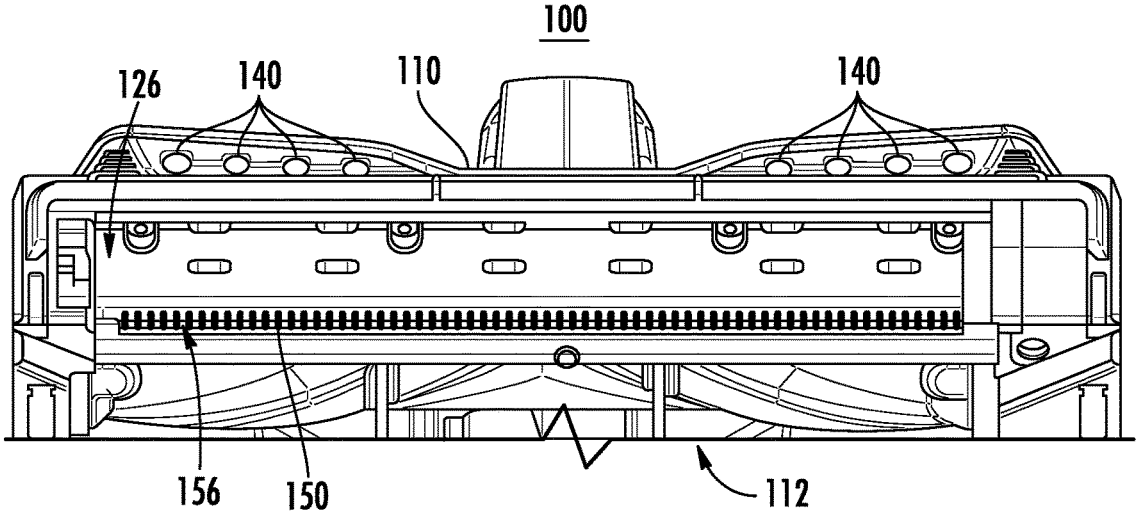
FIG. 7 is a front bottom view of the front region of the surface cleaning head of FIG. 1 without the leading roller.
Figure 8:
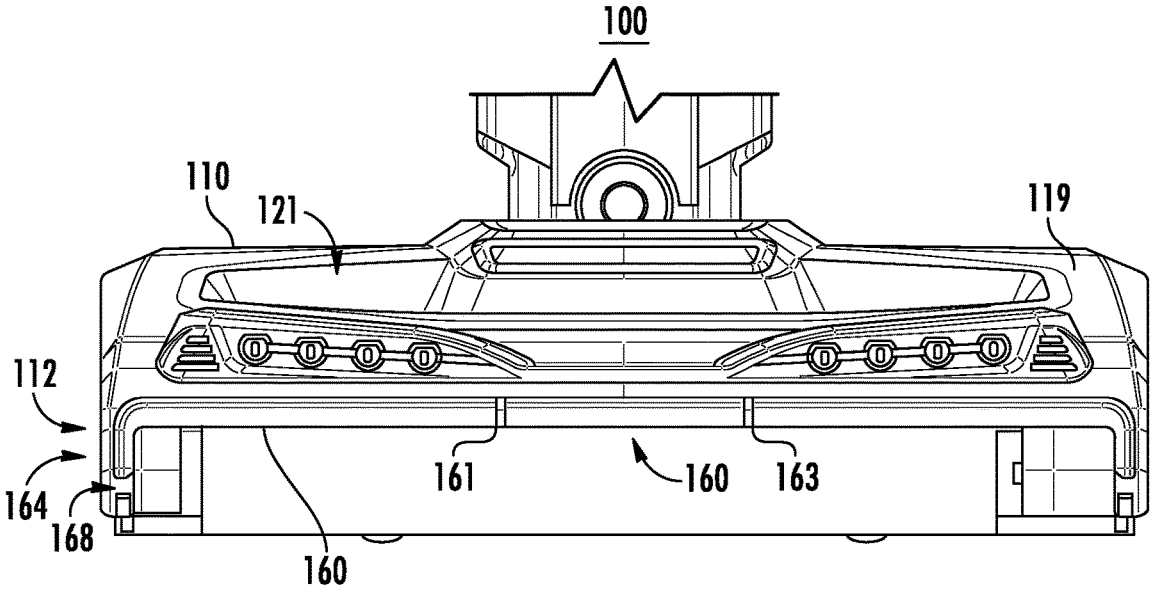
FIG. 8 is a front view the surface cleaning head of FIG. 1.

As shown in FIG. 7, an embodiment of the surface cleaning head 100 optionally includes an electrostatic discharge element (ESD) 156. The ESD 156 may reduce and/or prevent the buildup of electrostatic charge on the surface cleaning head 100. The ESD 156 may include any known device for discharging electrostatic charge. According to one embodiment, the ESD 156 may include Barnet fibers woven between the openings in the back of the leading roller chamber 126. The Barnet fibers may be arranged in close proximity to the combing protrusions 150 and/or leading roller 124 for discharging. For example, the ESD 156 may be connected to a printed circuit board assembly (PCBA) that dumps charge out to the neutral AC line.

In some embodiments, the housing 110 may further include a bumper 160 forming a top part of the front side 112 of the housing 110, as shown in FIGS. 1, 3, 5, and 8. The bumper 160 may reduce potential damage to either the surface cleaning head 100 and/or other objects in the environment. A front portion of the leading roller 124 is exposed at the front side 112 of the housing 110, and the bumper 160 may extend around at least a top of the leading roller 124. In the example embodiment, the bumper 160 includes a lateral portion 162 extending laterally along the front side 112 of the housing 110 and side portions 164, 168 extending downwardly along left and right sides of the front side 112 of the housing 110. The side portions 164, 168 may extend to a point at or below the second rotation axis RA2 of the leading roller 124.

The bumper 160 may optionally define one or more front edge vacuum passageways 168, 169 providing at least a portion of the air flow path. As shown in FIG. 4, the bumper 160 may therefore generally form a seal with a vertical surface 12 (e.g., wall or the like) to improve front edge cleaning. The front edge vacuum passageways 168, 169 may allow for increased airspeed of the air being sucked into the surface cleaning head 100, thereby enhancing front edge cleaning. The bumper 160 may also include one or more lateral air passageways disposed in the lateral portion 162, which also allow for increased airflow along the front side 112.

The bumper 160 may also include one or more compression elements 161, 163 (e.g., ribs) disposed on the lateral edge/section 162. The compression elements 161, 163 allow for increased resiliency and cushioning of the bumper 160. When the bumper 160 is pushed against the vertical surface 12 (FIG. 4), the compression elements 161, 163 contact the surface 12 first and push the bumper 160 locally farther back than the rest of the bumper 160, thereby forming a gap on either side of the compression elements 161, 163. The gaps on either side of the compression elements 161, 163 form air paths allowing air to be drawn down in front of the leading roller 124, which may disturb dust and debris so that it can be directed into the air flow path toward the suction conduit.

The bumper 160 may be formed as one piece with the housing 110 or may be formed as a separate piece secured within a groove and/or notch 165 formed between two or more pieces (e.g., an upper and lower portion 110*a*, 110*b*) of the housing 110, as shown in FIG. 3. The groove and/or notch 165 may facilitate assembly of the housing 110 and the bumper 160 (e.g., between a headlight portion 110*a* and main portion 110*b* of the housing 110).

Figure 9:
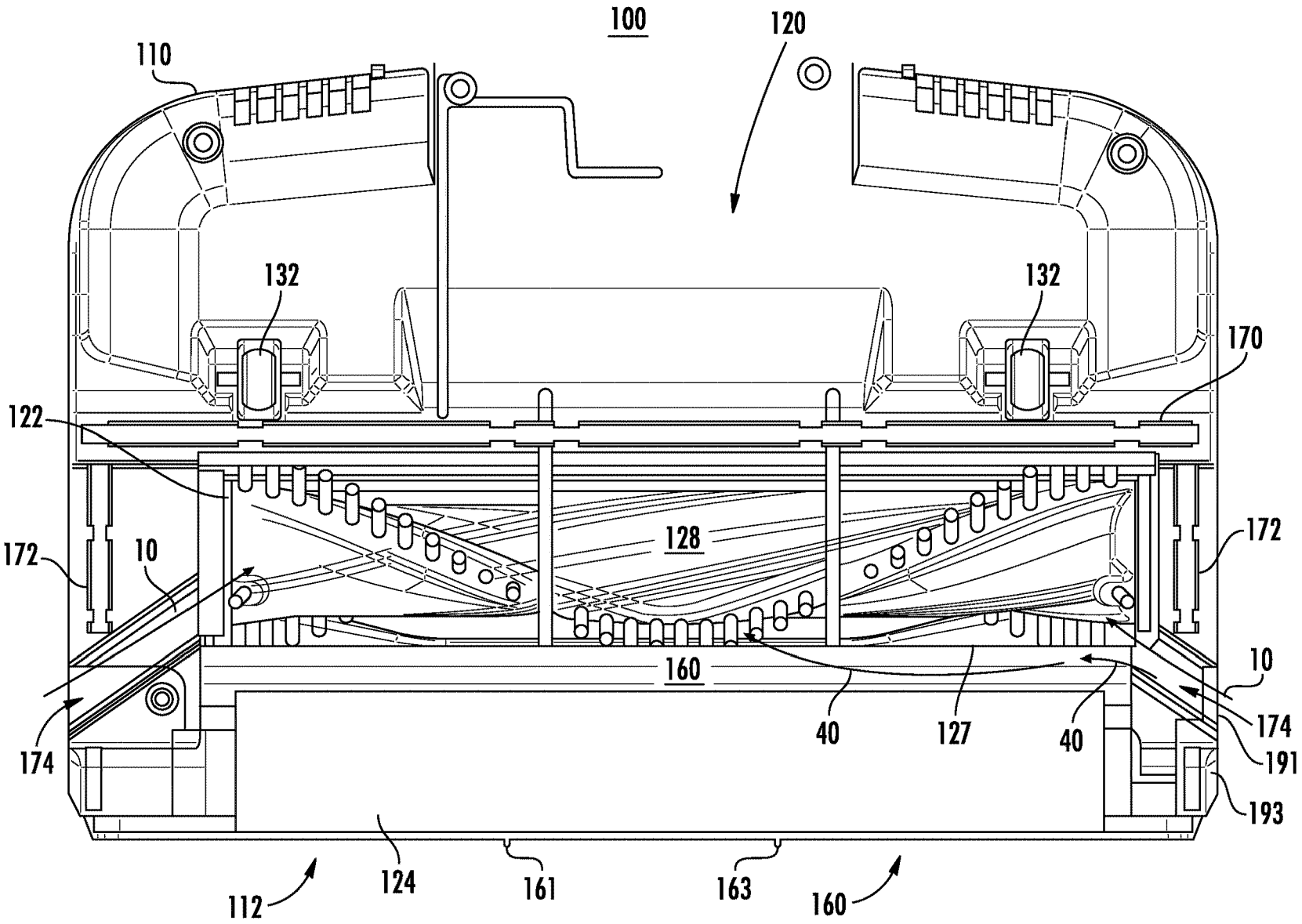
FIG. 9 is a bottom view the surface cleaning head of FIG. 1.
Figure 10:
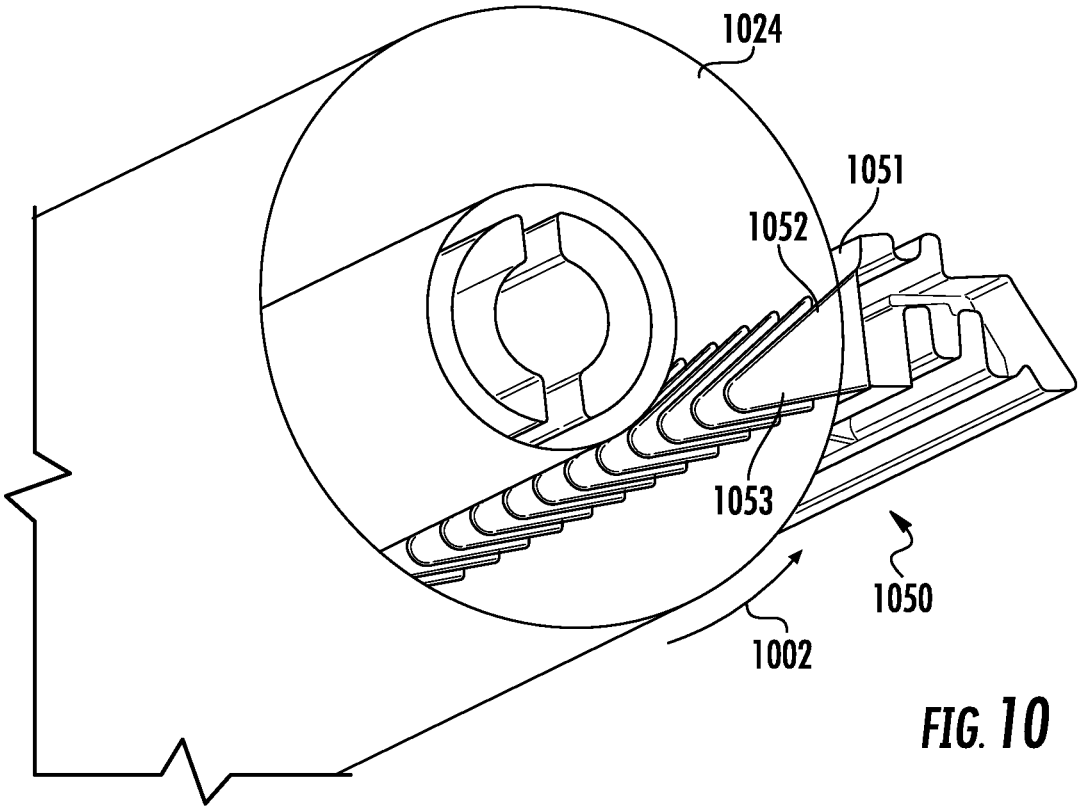
FIG. 10 is a perspective cross sectional view of combing protrusions engaging a cleaning roller, consistent with an embodiment of the present disclosure.
Figure 11:
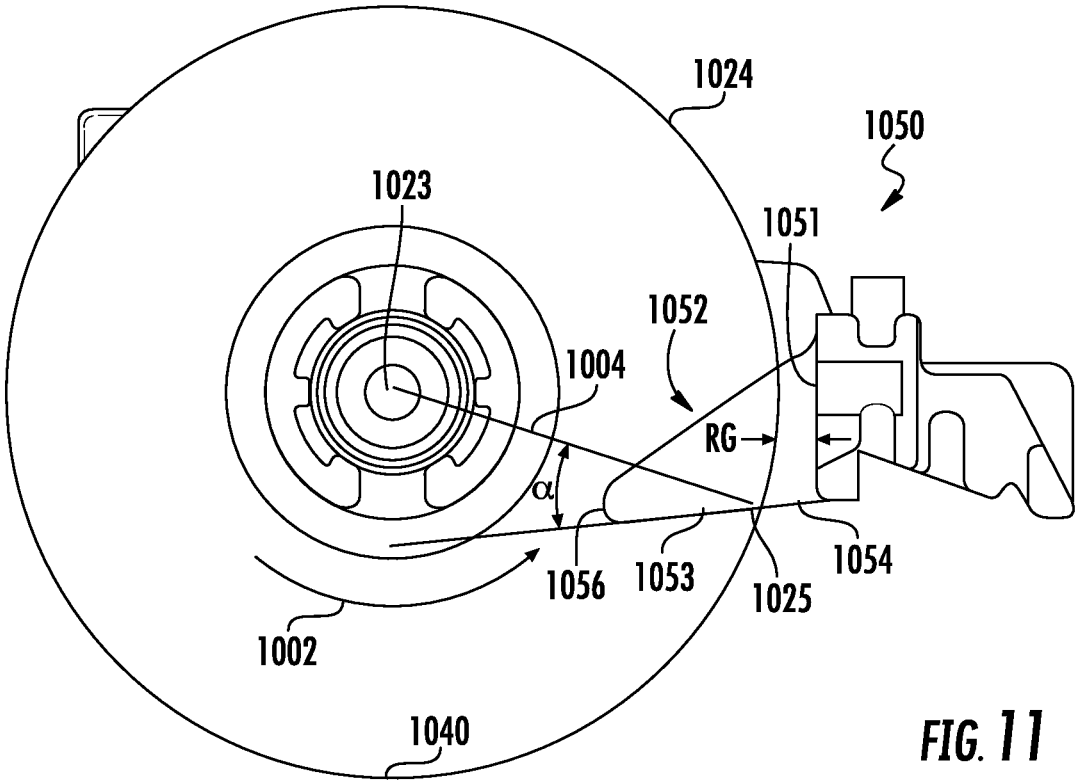
FIG. 11 is a side cross-sectional view of the combing protrusions engaging the cleaning roller.
Figure 12:
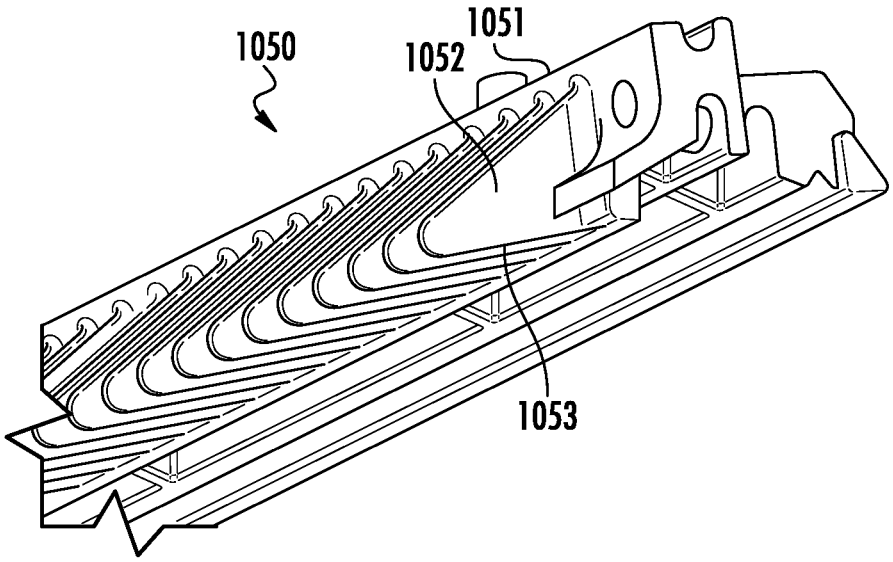
FIG. 12 is a side perspective view of the combing protrusions shown in FIG. 10.
Figure 13:
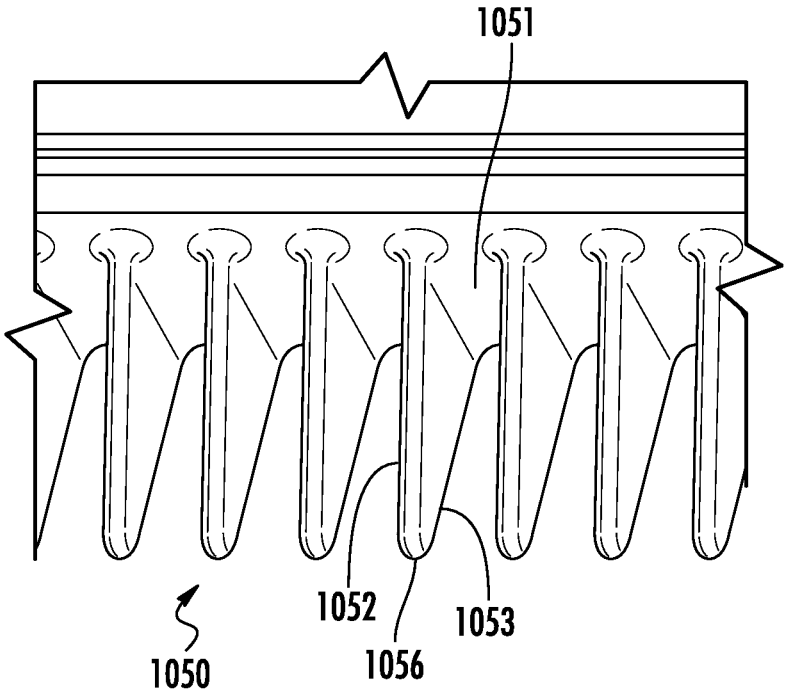
FIG. 13 is a top perspective view of a section of the combing protrusions shown in FIG. 10.
Figure 14A:
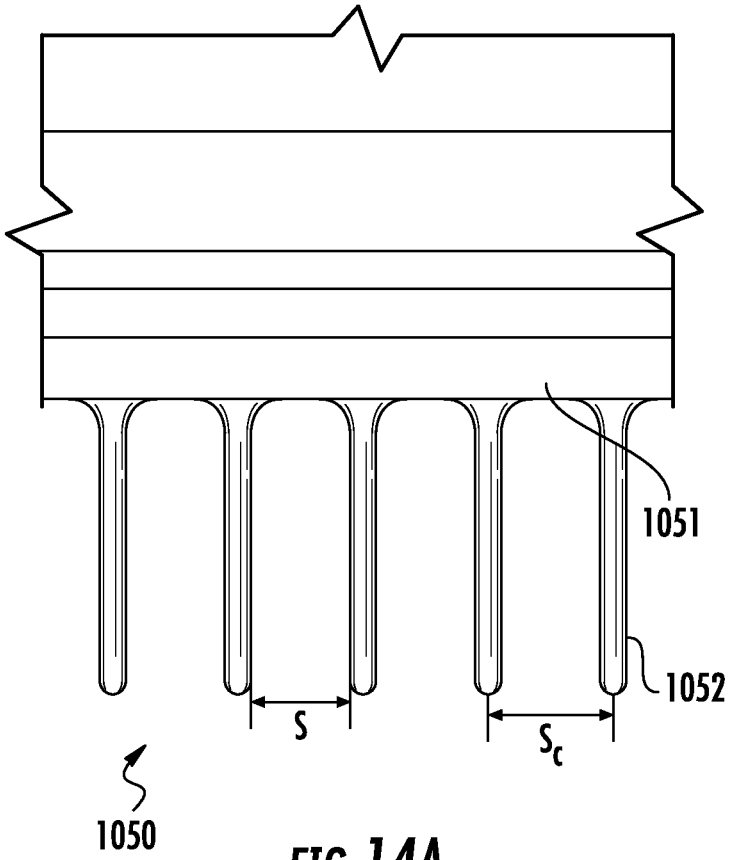
FIGS. 14A-14D are top, front, bottom and side views of the section of combing protrusions shown in FIG. 13.
Figure 14B:
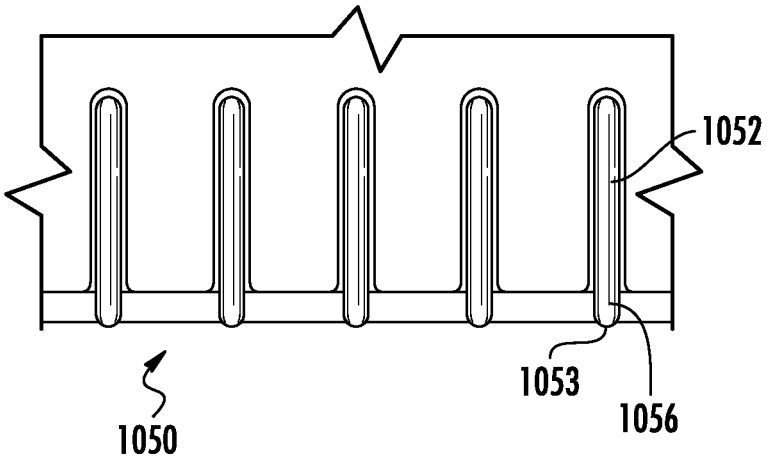
Figure 14C:
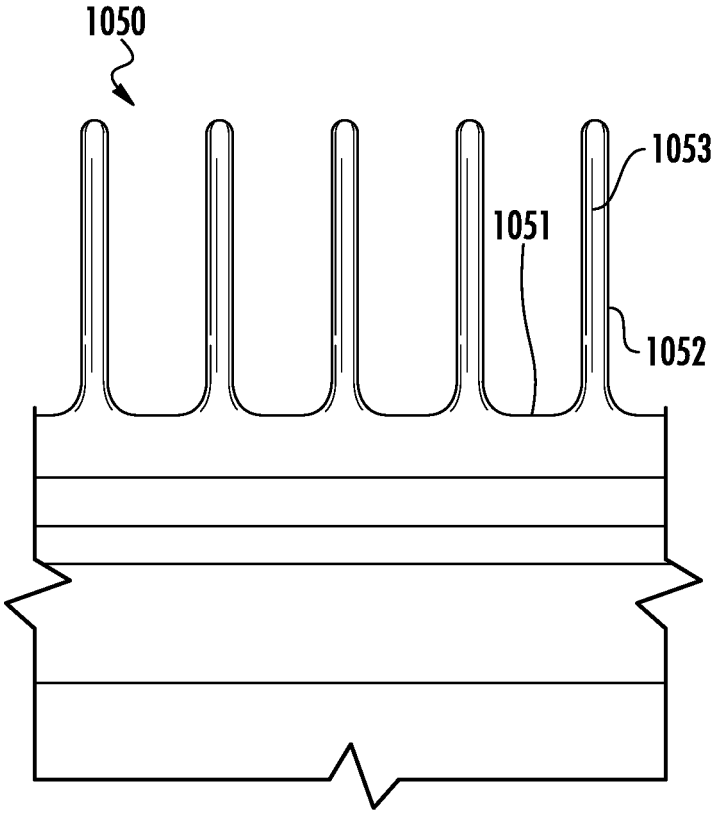
Figure 14D:
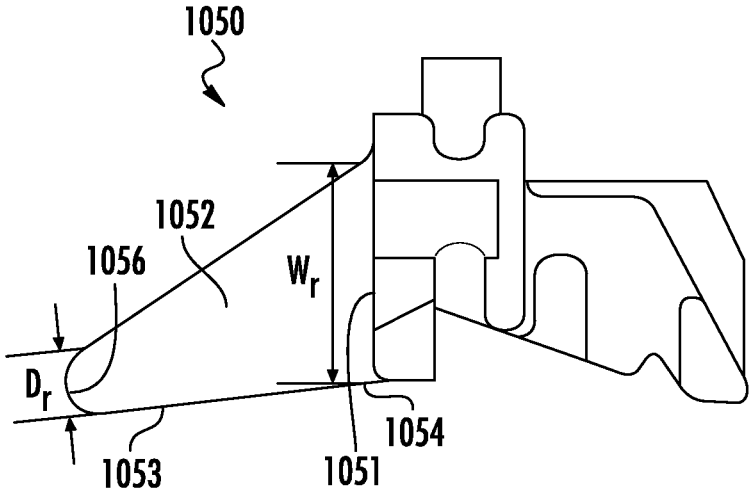

In some embodiments, the surface cleaning head 100 may further include one or more floor sealing strips 170, 172 and side edge vacuum passageways 174 on an underside of the housing 110, as shown in FIGS. 1 and 9. The floor sealing strip(s) 170, 172 may include one or more sections extending outwardly from the housing 110 and having a length sufficient to at least partially contact the surface 10 to be cleaned. The floor seals strip(s) 170, 172 may include soft bristles, fabric material, rubber material, or other material capable of contacting the surface being cleaned to substantially prevent air flow into the opening 127 of the suction conduit 128 from the rear side. The sealing strips 170, 172 may also include a combination of elements or materials, such as bristles with a rubber strip extending along the strip between the bristles (e.g., with the bristles being longer than the rubber strip).

In the example embodiment, a lateral floor sealing strip 170 extends along a rear lateral portion (e.g., behind the opening 127 of the suction conduit 128) and side sealing strips 172 extend partially along the left and right sides 116*a*, 116*b*. The side sealing strips 172 extend, for example, along a substantial portion of the opening 127 of the suction conduit 128 and are spaced from the leading roller 124 to define one or more side edge vacuum passageways 174 extending back towards the opening 127 of the suction conduit 128. Because the leading roller 124 itself forms a seal with the surface 10 being cleaned, additional sealing strips are unnecessary along the front side 112. Although separate strips 170, 172 are shown, one continuous sealing strip may be used. The floor sealing strips 170, 172 may enhance sealing between the surface cleaning head 100 and the floor 10, thereby enhancing the vacuum efficiency.

The side edge vacuum passageways 174 may enhance the side edge cleaning efficiency of the surface cleaning head 100. Side edge vacuum passageways 174 draw in air from the front 112 and the corner/sides 116*a*, 116*b* towards the suction conduit 128, thereby enhancing edge cleaning as well as front cleaning. At least one of the side edge vacuum passageways 474 may also direct air into the inter-roller air passageway 146 between the leading roller 124 and the brush roll 122 to facilitate removal of debris from the leading roller 124. As such, the side edge vacuum passageways 174 and the inter-roller air passageway 146 together provide at least a portion of the primary air flow path (e.g., as indicated by arrows 40) into the suction conduit 128.

The side edge vacuum passageways 174 may be arranged at an approximately 45 degree angle with respect the longitudinal axis of the housing 110. In other embodiments, the angle of the side edge vacuum passageways 174 may be within 30 to 60 degrees with respect the longitudinal axis of the housing 110. Although the side edge passageways are shown as angled straight passageways, other shapes and configurations (e.g., S shaped or curved) are also possible and within the scope of the present disclosure.

Referring to FIGS. 10-14D, a combing unit 1050 used for cleaning a cleaning roller 1024 in a cleaning apparatus is described in greater detail. The cleaning roller 1024 may be rotatably mounted in a housing, such as the surface cleaning head housing described above, with the combing unit 1050 engaging the cleaning roller 1024. The combing unit 1050 includes a series of spaced combing protrusions or teeth 1052 extending from a back support 1051 and extending partially into the cleaning roller 1024. Although the illustrated embodiment shows the combing unit 1050 with teeth 1052 extending from a single back support 1051, the combing unit 1050 may also include teeth extending from multiple back supports.

The combing unit 1050 may extend along a substantial portion of a length of the cleaning roller 1024 (i.e., more than half) such that the combing teeth 1052 remove debris from a substantial portion of the cleaning surface of the cleaning roller 1024. In an embodiment, the combing teeth 1052 may engage the cleaning surface of the cleaning roller 1024 along, for example, greater than 90% of a length of the cleaning surface of the cleaning roller 1024. The combing unit 1050 works particularly well with cleaning rollers that are designed to move hair and other similar debris away from a center of the roller 1024.

The combing teeth 1052 have angled leading edges 1053 that are not aligned with a rotation center 1023 of the cleaning roller 1024. The angled leading edges 1053 are the edges that an incoming portion of the rotating cleaning roller 1024 hits first and are directed toward or into a direction of rotation (i.e., into arrow 1002) of the cleaning roller 1020. More specifically, the leading edge 1053 of a combing tooth 1052 forms an acute angle $\alpha$ relative to a line 1004 extending from an intersection point 1025 where the leading edge 1053 intersects with an outer surface of the cleaning roller 1024 to the rotation center 1023. In some embodiments, the angle $\alpha$ is in a range of 5° to 50° and more specifically in a range of 20° to 30° and even more specifically about °24 to 25°.

In some embodiments, the combing teeth 1052 are positioned as close as possible to the bottom contact point 1040 of the cleaning roller 1024 but high enough to prevent being caught on a surface being cleaned (e.g., a carpet). The combing teeth 1052, for example, may be positioned just above the lowest structure on the housing of a cleaning apparatus. Positioning the combing teeth 1052 closer to the bottom contact point 1040 of the cleaning roller 1024 allows debris to be intercepted and removed as soon as possible, thereby improving debris removal.

Figure 15A:
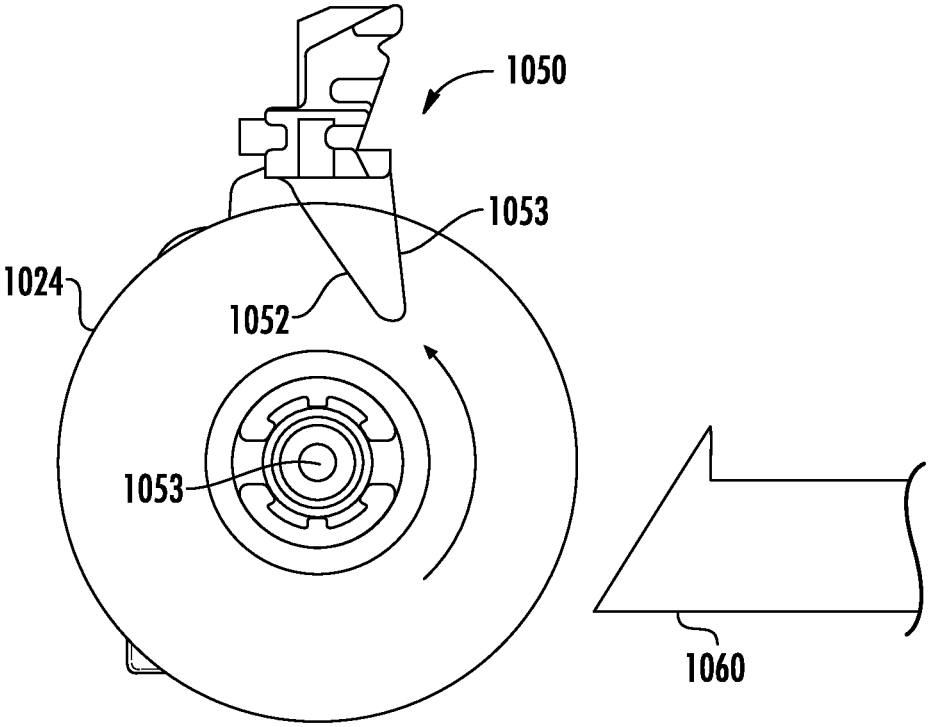
FIG. 15A is a side cross-sectional view of the combing protrusions engaging a cleaning roller above an axis of rotation, consistent with another embodiment.

In another embodiment, shown in FIG. 15A, the combing unit 1050 may have other orientations and positions relative to the cleaning roller 1024 (e.g., above the rotation center 1023). In a robotic vacuum cleaner, for example, the combing unit 1050 may be positioned higher to prevent the combing teeth 1052 from interfering with the debris being deposited into a dust bin 1060.

The combing teeth 1052 may extend into the cleaning roller 1024 to a depth in a range of 0% to 50% of the cleaning roller radius for a soft roller and 0% to 30% of the cleaning roller radius for a tufted brush roll. In one embodiment, the cleaning roller 1024 is a soft roller (e.g., nylon bristles with a diameter less than or equal to 0.15 mm and a length greater than 3 mm) and the combing teeth 1052 extend into the soft cleaning roller 1024 in a range of 15% to 35%. The combing protrusions 1052 may be positioned to provide a root gap or spacing between the back support 1051 and the outer surface of the cleaning roller 1024 such that air may flow between the cleaning roller 1024 and the back support 1051 and through the roots of the combing teeth 1052. The air flow through the roots of the combing teeth 1052 may help to dislodge debris that has been removed from the cleaning roller 1024 and to direct the debris into an air flow passageway toward a suction conduit of a cleaning apparatus. The root gap may have a width RG in a range of 1 to 3 mm and more specifically a range of 2 to 3 mm. The root gap RG may extend across an entire length of the combing unit 1050, or a root gap RG may be formed only in one or more sections along the length of the combing unit 1050 to form air channels only at those sections. In other embodiments, the back support 1051 of the combing unit 1050 may contact the outer surface of the cleaning roller 1024 to provide sealing and force air to flow under the cleaning roller 1024.

In the illustrated embodiment (FIGS. 11 and 14D), the combing teeth 1052 have a triangular-shaped "tooth" profile with a wider base or root 1054 having a root width $W_r$ and a tip 1056 having a diameter $D_r$. In general, the base or root 1054 may be wide enough to prevent the tooth 1052 from bending upward when contacted by the rotating cleaning roller 1024 and the tip 1056 may be sharp enough to catch the debris. In some embodiments, the tip 1056 may be rounded with a diameter in the range of less than 3 mm and more specifically in the range of 1 to 2 mm and even more specifically about 1.6 mm. The root width $W_r$ may be in a range of 5 to 6 mm.

Figure 15B:
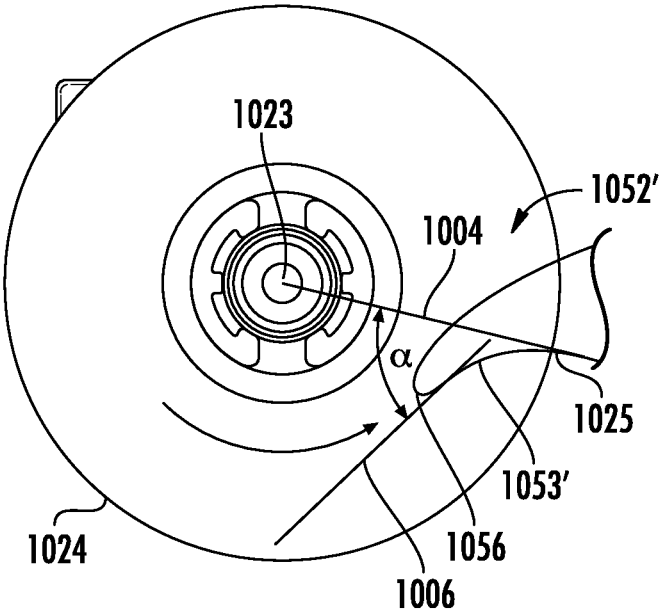
FIG. 15B is a side cross-sectional view of a combing protrusion having a curved leading edge engaging a cleaning roller, consistent with a further embodiment.

In another embodiment, shown in FIG. 15B, combing teeth 1052' have a curved profile with curved leading edges 1053' forming a concave curve. In this embodiment, a line 1006 extending from the curved leading edge 1053' at the tip 1056 forms an angle $\alpha$ with the line 1004 extending from the intersection point 1025 to the rotation center 1023. The combing teeth 1052' with curved edges may be positioned and spaced similar to the teeth 1052 with straight leading edges 1053 as described and shown herein.

In some embodiments, the combing unit 1050 includes combing teeth 1052 spaced 4 to 16 teeth per inch and more specifically 7 to 9 teeth per inch. The combing teeth 1052 may be made of plastic or metal and may have a thickness that provides a desired rigidity to prevent bending when engaged with the rotating cleaning roller 1024. In some embodiments, the combing teeth 1052 may have a thickness in a range of 0.5 to 2 mm depending upon the material. In one example, the combing teeth 1052 are made of plastic and have a thickness of 0.8 mm, a spacing S of about 2.4 mm, and a center-to-center spacing $S_c$ of about 3.3 mm.

Although the combing unit 1050 is shown with combing teeth 1052 having an equal spacing, a combing unit 1050 may also include teeth 1052 with different spacings including, for example, groups of equally spaced teeth. The combing unit 1050 may include a section at the center of the cleaning roller 1024 with no teeth and groups of combing teeth 1052 proximate ends of the cleaning roller 1024 where the hair and similar debris migrates during rotation. Although the combing unit 1050 is shown with teeth 1052 having the same shape or tooth profile and dimensions, the combing unit 1050 may include teeth of different shapes, profiles dimensions and configurations at different locations along the combing unit 1050.

Figure 16:
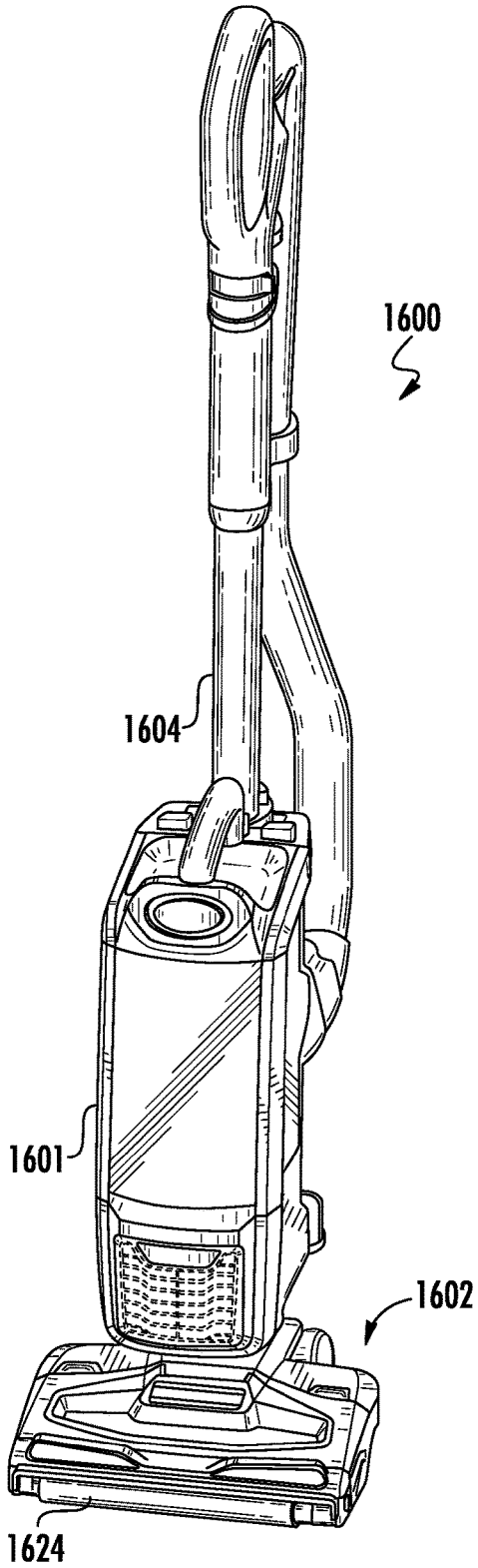
FIG. 16 is a perspective view of an upright vacuum cleaner including a surface cleaning head with dual rotating agitators and combing protrusions, consistent with embodiments of the present disclosure.
Figure 17:
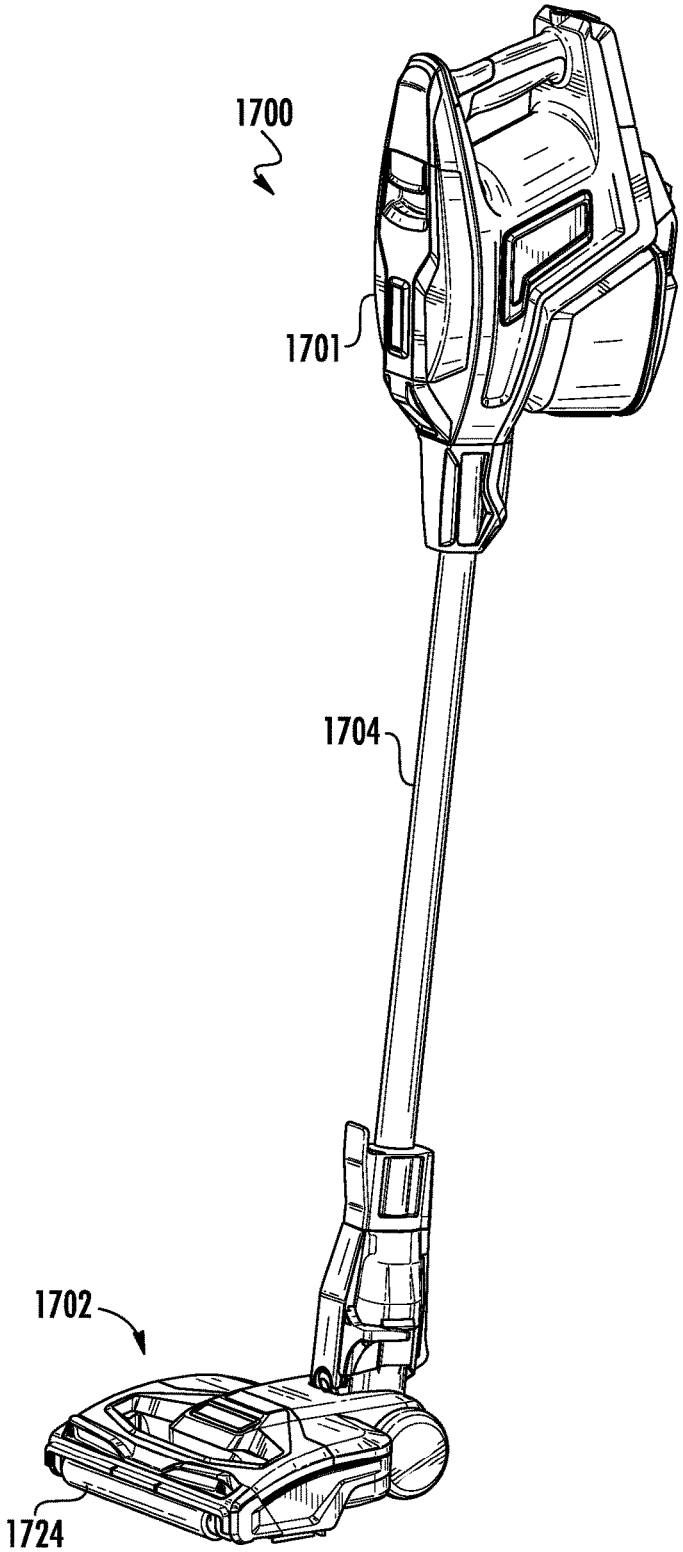
FIG. 17 is a perspective view of a stick type vacuum cleaner including a surface cleaning head with dual rotating agitators and combing protrusions, consistent with embodiments of the present disclosure.

FIGS. 16 and 17 illustrate examples of two different types of vacuum cleaners 1600, 1700 that may include a surface cleaning head 1602, 1702 with dual agitators including a leading roller 1624, 1724 and a combing unit (not shown), consistent with the embodiments described herein. The surface cleaning head 1602 with the leading roller 1624 may be used on an upright vacuum cleaner 1600 with a removable canister 1601 coupled to a wand 1604, such as the type described in U.S. Patent Application Pub. No. 2015/0351596, which is commonly owned and fully incorporated herein by reference. The surface cleaning head 1702 with the leading roller 1724 may be used on a stick type vacuum cleaner 1700 with a removable handheld vacuum 1701 coupled at one end of a wand 1704, such as the type described in U.S. Patent Application Pub. No. 2015/0135474, which is commonly owned and fully incorporated herein by reference.

Figure 18:
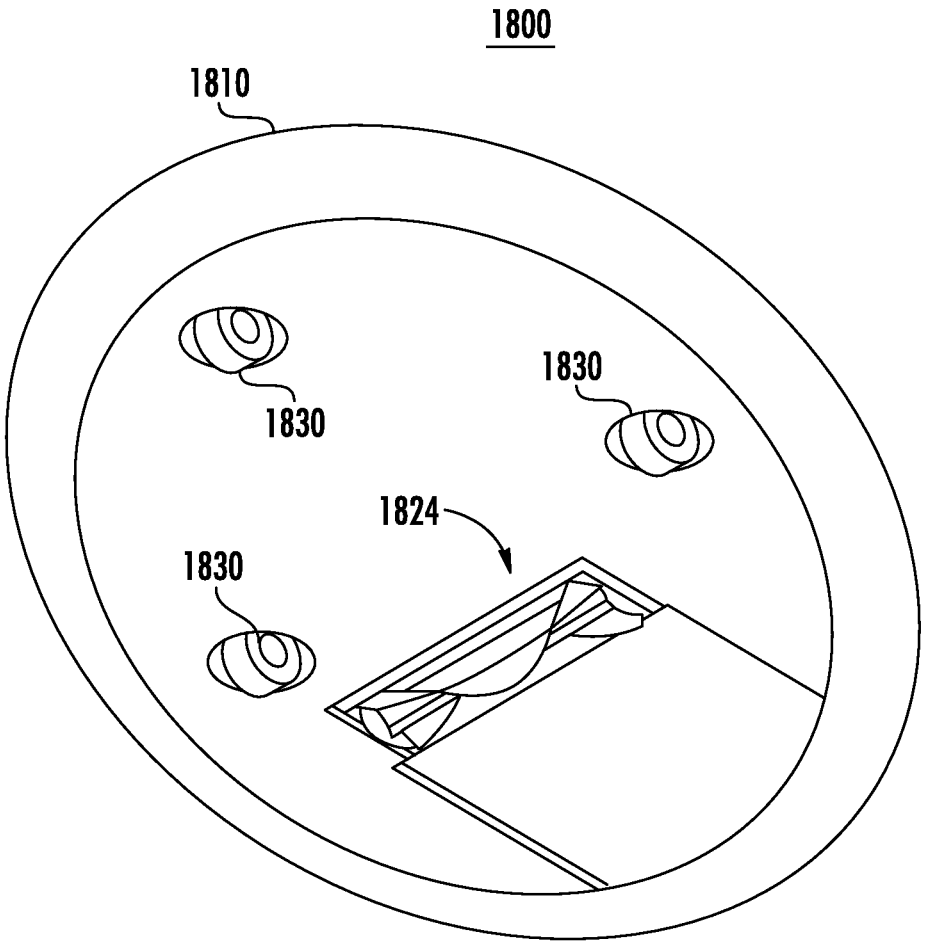
FIG. 18 is a bottom perspective view of a robotic vacuum cleaner including a cleaning roller and combing protrusions, consistent with yet another embodiment of the present disclosure.

FIG. 18 illustrates a robotic vacuum cleaner 1800 that includes a housing 1810 and a cleaning roller 1824 with a combing unit (not shown) as disclosed herein. The robotic vacuum cleaner 1800 may also include one or more wheels 1830 for moving about a surface to be cleaned. An example of the combing unit used in a robotic vacuum cleaner is disclosed in greater detail in U.S. Provisional Application No. 62/469,853, filed Mar. 10, 2017, which is incorporated herein by reference.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A cleaning apparatus comprising:

a housing having a front side and back side, the housing including a suction conduit fluidly coupled to an opening on an underside of the housing between the front side and the back side, the suction conduit fluidly coupled to a suction motor;

a brush roller rotatably mounted to the housing wherein the section conduit extends at least partially behind the brush roller;

a leading roller mounted in the housing in front of the brush roller and spaced from the brush roller such that a position of the leading roller relative to the housing is fixed and the leading roller and brush roller do not contact each other;

one or more drive mechanisms coupled to the brush roller and the leading roller configured to simultaneously drive the brush roller and the leading roller; and a combing unit including a series of spaced combing protrusions configured to contact an outer surface of the lower portion of the leading roller at a height between the rotation center of the leading roller and the bottom contact surface of the leading roller.

2. The cleaning apparatus of claim 1, wherein the combing protrusions have roots at the back support and the tips at an opposite end from the roots, the combing protrusions being wider at the roots than at the tips.

3. The cleaning apparatus of claim 1, wherein the combing protrusions include leading edges that form an acute angle relative to a line extending from an intersection point of the leading edge and the leading roller to a rotation center of the leading roller.

4. The cleaning apparatus of claim 3, wherein the acute angle is in a range of 5° to 50°.

5. The cleaning apparatus of claim 3, wherein the acute angle is in a range of 20° to 30°.

6. The cleaning apparatus of claim 1, wherein the combing protrusions include spaced combing teeth extending from one or more back supports to tips, and wherein at least some of the tips are rounded with a diameter in a range less than 3 mm.

7. The cleaning apparatus of claim 6, wherein at least some of the tips are rounded with a diameter in a range of 1 to 2 mm.

8. The cleaning apparatus of claim 1, wherein at least some of the combing protrusions have a curved profile with at least the leading edge forming a concave curve.

9. The cleaning apparatus of claim 1, wherein at least some of the combing protrusions have a triangular-shaped profile.

10. The cleaning apparatus of claim 1, wherein the combing unit is spaced across at least 90% of a length of the cleaning roller.

11. The cleaning apparatus of claim 1, wherein the combing protrusions are spaced 4 to 16 teeth per inch.

12. The cleaning apparatus of claim 1, wherein the combing protrusions are spaced 7 to 9 teeth per inch.

13. The cleaning apparatus of claim 1, wherein the combing protrusions have a thickness in a range of 0.5 to 2 mm.

14. The cleaning apparatus of claim 1, wherein the combing protrusions are made of plastic.

15. The cleaning apparatus of claim 1, wherein the combing protrusions extend into the cleaning roller about 15% to 35% of a radius of the leading roller.

16. The cleaning apparatus of claim of claim 15, wherein the leading roller includes nylon bristles having a diameter less than or equal to 0.15 mm and a length greater than 3 mm.

17. The cleaning apparatus of claim 1, wherein the housing defines an inter-roller air passageway between lower portions of the brush roller and the leading roller and below the combing protrusions, the inter-roller air passageway being in fluid communication with the suction conduit of the housing.

18. The cleaning apparatus of claim 1, wherein an upper portion of the leading roller above the combing protrusions is outside of the suction conduit.

19. A robotic vacuum cleaner comprising:

the cleaning apparatus as recited in claim 1.

20. A sweeper comprising:

the cleaning apparatus as recited in claim 1; and a wand coupled at one end to the cleaning apparatus.

21. An stick vacuum comprising:

the cleaning apparatus as recited in claim 1;

a wand coupled at one end to the cleaning apparatus; and a hand vacuum removably coupled to an opposite end of the wand.

22. An upright canister vacuum comprising:

the cleaning apparatus as recited in claim 1;

a wand coupled at one end to the cleaning apparatus; and a removable canister coupled to the wand.

23. The cleaning apparatus of claim 1, wherein the combing protrusions extend from a back support partially into the leading roller and have angled leading edges extending from the back support to tips that are not aligned with a center of rotation of the leading roller and are directed into a direction of rotation of the leading roller;

wherein the combing protrusions engage the leading roller such that a root gap is formed between the back support and an outer surface of the leading roller, the root gap being in a range of 1 to 3 mm such that air flows between the leading roller and the back support and through roots of the combing protrusions to dislodge debris that has been removed from the leading roller and to direct the debris into an air flow passageway towards the suction conduit of the cleaning apparatus.

24. A surface cleaning head comprising:

a housing having a front side and back side, the housing including an agitator chamber, a suction conduit extending from agitator chamber;

a brush roller rotatably mounted within the agitator chamber such that at least a portion of the brush roller is in front of a dirty air inlet of the suction conduit;

a leading roller mounted to the housing in front of the brush roller and spaced from the brush roller such that a position of the leading roller relative to the housing is fixed and the leading roller and brush roller do not contact each other and define an inter-roller air passageway, the inter-roller air passageway forming at least a portion of a flow path into the opening of the suction conduit in a region between a lower portion of the brush roller and a lower portion of the leading roller, wherein at least an inside of the lower portion of the leading roller is exposed to the flow path flowing through the inter-roller air passageway to the suction conduit and wherein at least an inside of an upper portion of the leading roller is substantially outside of the flow path to the suction conduit;

one or more drive mechanisms coupled to the brush roller and the leading roller configured to simultaneously drive the brush roller and the leading roller; and debriding protrusions configured to contact an outer surface of the lower portion of the leading roller to remove debris from the leading roller, the debriding protrusions exposed to the inter-roller passageway such that the removed debris falls into the inter-roller passageway and into the flow path to the opening of the suction conduit.

* * * * *